US010808311B2

(12) United States Patent
Sakurada et al.

(10) Patent No.: US 10,808,311 B2
(45) Date of Patent: Oct. 20, 2020

(54) NITRIDED PLATE PART AND METHOD FOR PRODUCING THE SAME

(71) Applicants: NIPPON STEEL & SUMITOMO METAL CORPORATION, Tokyo (JP); UNIPRES CORPORATION, Yokohama-shi, Kanagawa (JP)

(72) Inventors: Eisaku Sakurada, Tokyo (JP); Shinya Saitoh, Tokyo (JP); Yoshinori Hyodo, Yokohama (JP); Kazuya Miura, Yokohama (JP); Michiko Wakatuki, Yokohama (JP)

(73) Assignees: NIPPON STEEL CORPORATION, Tokyo (JP); UNIPRES CORPORATION, Yokohama-shi, Kanagawa (JP)

( * ) Notice: Subject to any disclaimer, the term of this patent is extended or adjusted under 35 U.S.C. 154(b) by 219 days.

(21) Appl. No.: 15/781,396

(22) PCT Filed: Dec. 2, 2016

(86) PCT No.: PCT/JP2016/085876
§ 371 (c)(1),
(2) Date: Jun. 4, 2018

(87) PCT Pub. No.: WO2017/094876
PCT Pub. Date: Jun. 8, 2017

(65) Prior Publication Data

US 2018/0363122 A1 Dec. 20, 2018

(30) Foreign Application Priority Data

Dec. 4, 2015 (JP) ..... 2015-237602

(51) Int. Cl.

| | |
|---|---|
| ***C23C 8/26*** | (2006.01) |
| ***C21D 9/46*** | (2006.01) |
| ***C21D 1/06*** | (2006.01) |
| ***C22C 38/54*** | (2006.01) |
| ***C21D 8/02*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |

(Continued)

(52) U.S. Cl.
CPC ..... *C23C 8/26* (2013.01); *C21D 1/06* (2013.01); *C21D 6/004* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0263* (2013.01); *C21D 8/0278* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01)

(58) Field of Classification Search
CPC ..... C21D 9/46; C21D 8/0205; C21D 8/0226; C21D 8/0278; C21D 6/004; C21D 1/06; C21D 8/0263; C21D 6/005; C21D 6/007; C21D 6/008; C23C 8/26; C22C 38/001; C22C 38/54; C22C 38/52
See application file for complete search history.

(56) References Cited

U.S. PATENT DOCUMENTS

2014/0334966 A1 11/2014 Sakurada et al.

FOREIGN PATENT DOCUMENTS

CN 102089452 A 6/2011
CN 102421927 A 4/2012
(Continued)

OTHER PUBLICATIONS

Written Opinion of the International Searching Authority for PCT/JP2016/085876 dated Jan. 24, 2017.
(Continued)

*Primary Examiner* — Jessee R Roe
(74) *Attorney, Agent, or Firm* — Birch, Stewart, Kolasch & Birch, LLP

(57) ABSTRACT

[Object] To provide a nitrided plate part that exhibits fatigue strength equivalent to or better than that of a carburized member, and a method for producing the same.

[Solution] Provided is a nitrided plate part having predetermined components and structure. Nitrogen average content in a range in which a distance from a sheared end face of the part toward an interior of the nitrided plate part in a sheared end face normal direction is equal to or greater than 0.05 mm and equal to or less than 0.10 mm is equal to or greater than 0.4000% and equal to or less than 1.2000% in mass %, and minimum nitrogen content in a range in which the distance is equal to or greater than 0.015 mm and equal to or less than 0.200 mm is 0.0600% or more. After uncoiling a steel sheet coil, stretch and compressive deformation in a range of equal to or greater than 0.03% and equal to or less than 3.00% in amount of plastic strain are alternately applied to a surface layer of a steel sheet. Then, shearing and press-forming are performed to make the steel sheet into a plate part shape, without recoiling the steel sheet again. Then, nitriding is performed under predetermined conditions.

4 Claims, 9 Drawing Sheets

(51) Int. Cl.

| | |
|---|---|
| ***C22C 38/46*** | (2006.01) |
| ***C22C 38/48*** | (2006.01) |
| ***C22C 38/50*** | (2006.01) |
| ***C22C 38/52*** | (2006.01) |

(56) References Cited

FOREIGN PATENT DOCUMENTS

| | | | |
|---|---|---|---|
| CN | 102803542 | A | 11/2012 |
| CN | 103958713 | A | 7/2014 |
| CN | 104411847 | A | 3/2015 |
| CN | 104981556 | A | 10/2015 |
| CN | 105102659 | A | 11/2015 |
| JP | 6-26560 | A | 2/1994 |
| JP | 2001-73073 | A | 3/2001 |
| JP | 2004-292911 | A | 10/2004 |
| JP | 2007-162138 | A | 6/2007 |
| JP | 2009-299181 | A | 12/2009 |
| JP | 5251633 | B2 | 7/2013 |
| JP | 2015-127434 | A | 7/2015 |
| WO | WO 2013/077298 | A1 | 5/2013 |
| WO | WO 2015/190618 | A1 | 12/2015 |

OTHER PUBLICATIONS

Chinese Office Action and Search Report for counterpart Chinese Application No. 201680071139.2, dated Jul. 23, 2019, with partial English translation.

International Search Report for PCT/JP2016/085876 dated Jan. 24, 2017.

Written Opinion of the International Searching Authority for PCT/JP2016/085876 (PCT/ISA/237) dated Jan. 24, 2017.

Extended European Search Report for corresponding European Application No. 16870811.3, dated Mar. 14, 2019.

NITRIDED PLATE PART AND METHOD FOR PRODUCING THE SAME

TECHNICAL FIELD

The present invention relates to a nitrided plate part with excellent durability that is obtained by performing gas softnitriding treatment after performing a method for producing an adequate material and forming, and a method for producing the same, and for example, relates to a torque converter plate part and a method for producing the same.

BACKGROUND ART

An automobile and mechanical parts use a large number of parts subjected to surface hardening treatment. Surface hardening treatment is generally performed for the purpose of improving wear resistance and fatigue strength, and typical methods for surface hardening treatment include carburizing, nitriding, and induction hardening.

Nitriding treatment such as gas nitriding, gas softnitriding, and salt-bath softnitriding has an advantage in that heat treatment distortion can be made small, unlike other methods. Therefore, nitriding is surface hardening treatment suitable for a part subjected to precision working, such as a crankshaft or a transmission gear, or a part that requires shape precision after hardening treatment, such as a disc or a plate obtained by press-forming, among automobile members.

Nitriding treatment includes gas nitriding, salt-bath nitriding, and the like. Among them, gas softnitriding treatment performed in a bath or an atmosphere including carbon together with nitrogen may be performed in a short time by increasing nitriding potential, and can provide a part increased in surface-hardened layer depth in several hours. In this gas softnitriding treatment, a surface-hardened layer with a large surface hardening depth is formed, so that excellent wear resistance as a part can be obtained, and also, durability is greatly improved by an effect of surface hardening. According to the above description, gas softnitriding treatment is a technique excellent in dimension precision, wear resistance, and economic efficiency, and it is required that case hardening treatment for improving wear resistance be replaced with gas softnitriding treatment.

However, in regard to a part subjected to gas softnitriding treatment using steel material as a material, it is necessary to perform treatment in a temperature range of A1 point or less in order to form a surface compound layer with excellent wear resistance. Consequently, martensitic transformation as in carburizing treatment and induction hardening treatment does not occur; thus, in general, residual stress of compression caused in a surface layer of the part is small, and it is difficult to ensure durability equivalent to or better than that of a carburized member.

In a plate part that plays a role of power transmission constituting a torque converter, pawls are arranged on a plate side face joined to a turbine, and the plate part transmits power via a spring disposed in a piston. At this time, load is applied to the pawl in an in-plane direction of the plate, and stress concentration occurs around a corner between the plate and the pawl, so that a fatigue crack is likely to occur from this area. Durability of the part is improved by reducing stress caused in power transmission. Examples of a means therefor include making the corner between the plate and the pawl have a gentle shape and thickening, but these are not preferable in terms of spatial constraints and power transmission efficiency.

On the other hand, Patent Literature 1 discloses a technique for improving fatigue strength after gas softnitriding treatment. The technique disclosed in Patent Literature 1 improves fatigue characteristics by controlling dislocation density and metal structure of a steel sheet.

In addition, a torque converter plate part that plays a role of power transmission is generally obtained in the following manner: a steel sheet (base metal) serving as a material is subjected to shearing in a production process and then undergoes a pressing process to have a predetermined part shape. Therefore, even a final product is affected by properties of a rupture plane generated at the time of shearing. Even in a torque converter plate part subjected to gas softnitriding, an end face has high roughness and undergoes microscopic stress concentration, so that higher stress occurs.

For example, for the purpose of improving characteristics of a shear plane, Patent Literature 2 shows an invention of a steel sheet for a plate disc clutch. Patent Literature 3 shows an invention related to a steel sheet material improved in durability of a sheared end face by controlling dislocation density of the material. These techniques are both very effective for uses in which a fatigue crack is likely to occur from a shear plane.

CITATION LIST

Patent Literature

Patent Literature 1: WO 2015/190618
Patent Literature 2: JP 2001-73073A
Patent Literature 3: WO 2013/077298

SUMMARY OF INVENTION

Technical Problem

However, the technique disclosed in Patent Literature 1 is a technique for improving fatigue characteristics of a planar portion, and does not allow sufficient fatigue strength to be achieved even if applied to a nitrided plate part. This is because fatigue strength of a nitrided plate part is determined by durability of a sheared end face. In addition, setting a ferrite fraction to 80% or more in a steel sheet having components including Ti and Nb, as described in Patent Literature 1, causes a decrease in fatigue strength in a planar portion of the nitrided plate part. That is, yield elongation occurs in ferrite steel including Ti and Nb. This yield elongation causes a wrinkle pattern to be formed on the surface of a pressed part at a stage before nitriding treatment. This wrinkle pattern brings about stress concentration and thus reduces fatigue strength of a surface other than a sheared end face. Furthermore, in the case where there is a sheared end face, microscopic stress concentration occurs at the sheared end face and a surface ridge line of the pressed part, which significantly reduces fatigue strength of the sheared end face.

In addition, as will be described later, it has been found by studies by the present inventors that the technique described in Patent Literature 3 cannot be applied in order to cause a torque converter part subjected to gas softnitriding to exhibit durability equivalent to or better than that of a carburized member. This is because in a torque converter part subjected to gas softnitriding, a crack occurs not from a sheared end face but from an interior near the sheared end face. Patent Literature 3 evaluates fatigue strength of a sheared end face by a plane bending fatigue test with a punching hole. In this plane bending fatigue test with a punching hole, an edge of a sheared end face of the punching hole (that is, a ridge line formed by the steel sheet surface and the sheared end face) undergoes highest stress. However, since a nitrided plate part undergoes load uniformly in an in-plane direction of a sheared end face, a fatigue crack occurrence behavior is different from that in the plane bending fatigue test with a punching hole. Therefore, the technique described in Patent Literature 3 cannot make fatigue strength of a nitrided plate part sufficiently high.

Hence, in view of the above problems, an object of the present invention is to provide a nitrided plate part that exhibits fatigue strength equivalent to or better than that of a carburized member, and a method for producing the same.

Solution to Problem

The present inventors organized, by various factors, features of a position where a fatigue crack occurred from an interior of the part near the sheared end face. Consequently, they found that fatigue strength of a nitrided plate part typified by a torque converter plate part subjected to gas softnitriding treatment (hereinafter, a torque converter plate part subjected to gas softnitriding treatment is also simply called "nitrided plate part" or "plate part") is favorably correlated with a fatigue crack occurrence position, and furthermore, controlling nitrogen concentration of the interior of the part to a predetermined value gives rise to fatigue strength equivalent to or better than that of a carburized member. Furthermore, as a result of continued studies, it was found that the fatigue crack occurrence position can be controlled by a shearing strain history of the part, and this is improved by limiting a chemical composition and production conditions of a material to specific ranges, so that fatigue strength is exhibited. According to these studies, fatigue strength of a nitrided plate part having a sheared end face, which had seemed to be difficult to even control, was successfully made equivalent to or better than fatigue strength of a carburized member (hereinafter called "carburized plate part" in some cases), and the present invention was devised. A specific means therefor is described below.

(1)

A nitrided plate part having a sheared end face, a sheet-thickness central portion in a portion at least 5 mm or more away from the sheared end face having a chemical composition consisting of, in mass %, C: equal to or greater than 0.025% and equal to or less than 0.113%, Si: 0.10% or less, Mn: equal to or greater than 0.71% and equal to or less than 1.49%, P: 0.020% or less, S: 0.0200% or less, Ti: equal to or greater than 0.020% and equal to or less than 0.091%, Cr: equal to or greater than 0.130% and equal to or less than 0.340%, Al: equal to or greater than 0.10% and equal to or less than 0.35%, N: equal to or greater than 0.0007% and equal to or less than 0.0300%, Nb: equal to or greater than 0% and equal to or less than 0.020%, Mo: equal to or greater than 0% and equal to or less than 0.140%, V: equal to or greater than 0% and equal to or less than 0.100%, B: equal to or greater than 0% and equal to or less than 0.0030%, Cu: equal to or greater than 0% and equal to or less than 0.13%, Ni: equal to or greater than 0% and less than 0.08%, W: equal to or greater than 0% and equal to or less than 0.07%, Co: equal to or greater than 0% and equal to or less than 0.07%, Ca: equal to or greater than 0% and less than 0.007%, Mg: equal to or greater than 0% and less than 0.005%, REM: equal to or greater than 0% and less than 0.005%, and the balance: Fe and impurities, in which nitrogen average content in a range in which a distance from the sheared end face in a sheared end face normal direction is equal to or greater than 0.05 mm and equal to or less than 0.10 mm is equal to or greater than 0.4000% and equal to or less than 1.2000% in mass %, and minimum nitrogen content in a range in which the distance is equal to or greater than 0.015 mm and equal to or less than 0.200 mm is 0.0600% or more, and an area ratio of ferrite structure in a metal structure is 70% or less.

(2)

The nitrided plate part according to (1), in which the nitrided plate part has a sheet thickness of equal to or greater than 1.0 mm and equal to or less than 8.0 mm.

(3)

The nitrided plate part according to (1), in which the nitrided plate part has a sheet thickness of greater than 1.2 mm and equal to or less than 6.0 mm.

(4)

A method for producing a nitrided plate part, including:

obtaining a steel sheet by performing hot rolling at hot finish rolling exit-side temperature in a range of equal to or greater than 850° C. and less than 960° C. on a slab having a chemical composition consisting of, in mass %, C: equal to or greater than 0.025% and equal to or less than 0.113%, Si: 0.10% or less, Mn: equal to or greater than 0.71% and equal to or less than 1.49%, P: 0.020% or less, S: 0.0200% or less, Ti: equal to or greater than 0.020% and equal to or less than 0.091%, Cr: equal to or greater than 0.130% and equal to or less than 0.340%, Al: equal to or greater than 0.10% and equal to or less than 0.35%, N: equal to or greater than 0.0007% and equal to or less than 0.0100%, Nb: equal to or greater than 0% and equal to or less than 0.020%, Mo: equal to or greater than 0% and equal to or less than 0.140%, V: equal to or greater than 0% and equal to or less than 0.100%, B: equal to or greater than 0% and equal to or less than 0.0030%, Cu: equal to or greater than 0% and equal to or less than 0.13%, Ni: equal to or greater than 0% and less than 0.08%, W: equal to or greater than 0% and equal to or less than 0.07%, Co: equal to or greater than 0% and equal to or less than 0.07%, Ca: equal to or greater than 0% and less than 0.007%, Mg: equal to or greater than 0% and less than 0.005%, REM: equal to or greater than 0% and less than 0.005%, and the balance: Fe and impurities;

then starting cooling within three seconds from an end of hot finish rolling, and cooling the steel sheet to equal to or greater than 460° C. and equal to or less than 630° C. within 29 seconds from the end of hot finish rolling;

coiling the steel sheet into a steel sheet coil;

in regard to the steel sheet coil further subjected to pickling, uncoiling the steel sheet coil, and then applying bending/unbending in a range of equal to or greater than 0.03% and equal to or less than 3.00% in amount of plastic strain to the steel sheet;

performing shearing and press-forming to make the steel sheet into a plate part shape, without recoiling the steel sheet again; and nitriding the steel sheet by causing the steel sheet to stay in a closed furnace adjusted to a temperature of equal to or greater than 500° C. and less than 620° C. with an atmosphere in which a volume constituent ratio of ammonia gas is greater than 30%, for a time of 60 minutes or more.

Advantageous Effects of Invention

According to the present invention, it is possible to give rise to fatigue strength equivalent to or better than that of a carburized member by controlling a fatigue crack occurrence position of a nitrided plate part, which has been considered to be difficult to even control. This significantly contributes to the industry by, for example, enabling production of a part achieving compatibility of economic efficiency of performance of the part.

DESCRIPTION OF EMBODIMENTS

Figure 1:
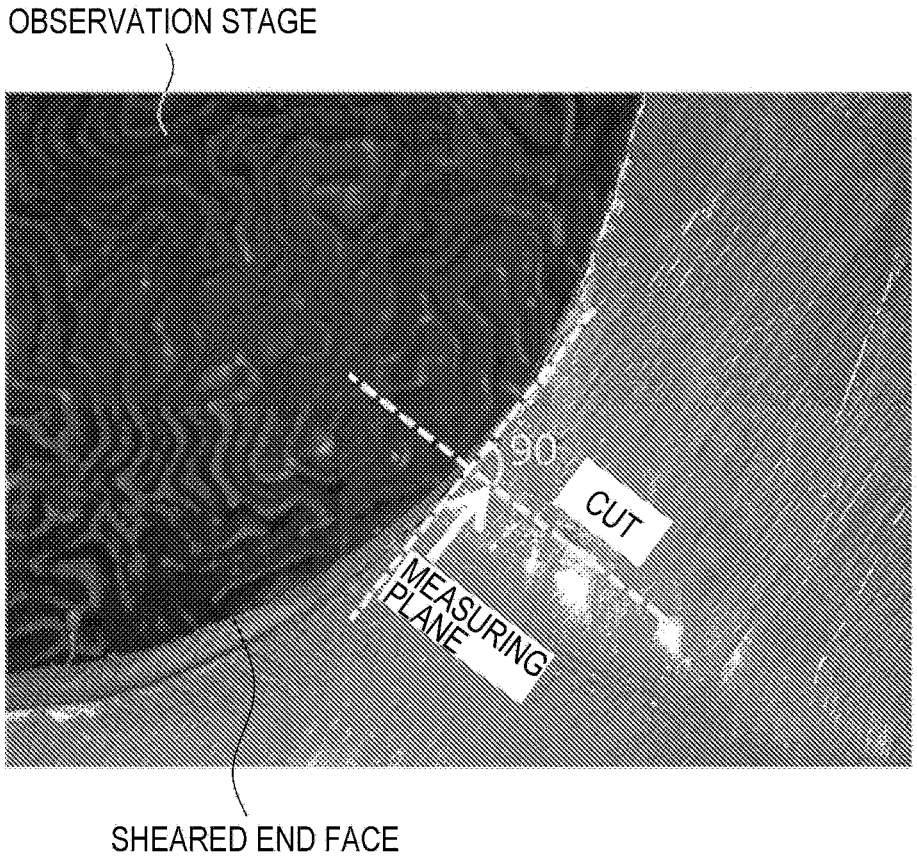
FIG. 1 is a microphotograph showing a cross-section of a measuring spot of a part having a round shape.

Hereinafter, (a) preferred embodiment(s) of the present invention will be described in detail with reference to the appended drawings.

1. Nitrided Plate Part

A nitrided plate part typified by a torque converter plate part is disposed perpendicularly to a rotation shaft, and consequently undergoes stress in an out-of-plane direction with respect to a shear plane of the plate; however, a fatigue crack occurs from not a sheared end face but an interior near the sheared end face. The present invention focuses on an occurrence position of this fatigue crack, researches the relationship with fatigue strength, and limits nitrogen content of a nitrided part and an average chemical composition of the part. Reasons for the limitations are described below.

1.1 Nitrogen Content

First, description is given on what led up to focusing on nitrogen content and reasons for limiting nitrogen content. Here, nitrogen content in the present invention is measured with an electron probe micro analyser (EPMA) device, and a value identified from a Kα line obtained by reflection of an electron beam applied by a W filament is adopted. Note that examples of a method for measuring nitrogen also include gas analysis, but this is not preferable as a measurement method because of poor spatial resolution.

In addition, nitrogen is caused by dirt such as oil on a surface being decomposed by an electron beam; hence, surface finish of a product to be measured is important. As a method for surface finish, it is necessary to cut a measuring plane, perform mirror finish with emery paper and microparticles of alumina or the like, then perform ultrasonic cleaning in a liquid such as acetone or ethanol, without performing corrosion by nital or the like, perform drying with a blower or the like, then perform drying in a closed container containing silica gel for at least 24 hours or more, and then perform measurement. Note that the closed container is preferably connected to a rotary pump or the like and increased in degree of vacuum to approximately $10^{-3}$ Torr.

Gas softnitriding treatment is performed in a closed furnace adjusted to an atmosphere described later; thus, a surface that comes into contact with the in-furnace atmosphere is nitrided uniformly. Therefore, a sheared end face at any spot of the nitrided plate part may be selected as a measuring spot of nitrogen content, cutting may be performed in a perpendicular direction from the sheared end face toward an interior of the plate part, the cut section may be subjected to surface finish by the above-described method, and nitrogen content may be measured. It is to be noted that, since a surface other than the sheared end face is also nitrided, as positions not affected thereby, measuring positions in a sheared end face direction are set as follows: nitrogen content may be measured at intervals of equal to or greater than 0.001 mm and equal to or less than 0.005 mm, along a line in a range within ±0.1 mm from the sheet-thickness center.

Here, any sheared end face of the part may be selected; in consideration of measurement variation, measuring nitrogen content at at least three spots or more, five spots at maximum, is sufficient. Note that it is preferable to perform a fatigue test beforehand, and include a fatigue crack occurrence position as a measuring spot.

From on-line data of nitrogen content obtained by the above-described measurement method, a value that is obtained by dividing total nitrogen content obtained by interval integration by the number of measuring points in the interval, in a range in which a distance from the sheared end face in a sheared end face normal direction is equal to or greater than 0.05 mm and equal to or less than 0.10 mm, is taken as nitrogen average content of the spot of the part, and is defined as nitrogen average content of the nitrided plate part. A reason for this is described later.

Minimum nitrogen content in a range in which a distance from the sheared end face toward the interior of the nitrided plate part in the sheared end face normal direction is equal to or greater than 0.015 mm and equal to or less than 0.200 mm is defined as a value measured in the following manner.

That is, in on-line data of nitrogen content measured at intervals of equal to or greater than 0.001 mm and equal to or less than 0.005 mm in the sheared end face normal direction from the sheared end face in a range within ±0.1 mm from the sheet-thickness center as an origin point to the plate part interior side, as positions not affected by intrusion of nitrogen from a surface other than the sheared end face, an average value of three points including a certain measuring point and its adjacent points on both sides is found. The lowest value of the average value in the range of equal to or greater than 0.015 mm and equal to or less than 0.200 mm is called minimum nitrogen content.

Here, in the case of measuring this minimum nitrogen content, it is necessary to exclude a range in which the distance from the sheared end face toward the interior of the plate part in the sheared end face normal direction is less than 0.015 mm from a measurement range, because this is a region in which a nitride compound layer is formed. As a sample for measuring this minimum nitrogen content, any sheared end face of the part may be selected for nitrogen content. In addition, as a sample for measuring the minimum nitrogen content, the same sample as that for measuring nitrogen average content in the range in which the distance from the sheared end face in the sheared end face normal direction is equal to or greater than 0.05 mm and equal to or less than 0.10 mm may be used. However, in consideration of measurement variation, at least three spots or more need to be measured, and measurement of five spots at maximum is sufficient. In the present invention, an average value of minimum nitrogen content of the spots measured by the above method is defined as minimum nitrogen content in the range in which the distance from the sheared end face toward the interior of the plate part in the sheared end face normal direction is equal to or greater than 0.015 mm and equal to or less than 0.200 mm.

A maximum intrusion depth of nitrogen due to gas softnitriding is 0.6 mm at maximum. Therefore, measurement of a chemical composition of a steel sheet (base metal) not affected by gas softnitriding treatment originally may be performed in a sheet-thickness central portion 0.6 mm or more away from the sheared end face. However, in order to minimize the influence of an error in working of a test piece, or the like, in the present invention, a sheet-thickness central portion at least 5 mm or more away from the sheared end face is taken as a measuring position of chemical components of the steel material (base metal) including chemical components other than nitrogen. Measurement of chemical components of the steel material (base metal) before gas softnitriding treatment may be performed by any method as long as the separation is at least 5 mm or more. For example, the following method may be used. In regard to any sheared end face of the nitrided plate part, on-line measurement of nitrogen content etc. is performed at any intervals, such as equal to or greater than 0.001 mm and equal to or less than 0.005 mm, in an interval from a sheet-thickness central portion in a portion 5 mm away from the sheared end face in the normal direction as an origin point to a position 1 mm away from the origin point along a sheet-thickness central line, and an average value of nitrogen content etc. in the interval is found. Measurement of the average value may be performed for any three spots of the nitrided plate part, an average value thereof may be found, and this average value may be taken as nitrogen content etc. of a sheet-thickness central portion at a position at least 5 mm or more away from the sheared end face. However, chemical components other than nitrogen may be affected by microscopic component segregation, particularly center segregation, to show a measurement result different from components of an average sheet-thickness central portion, that is, original components of the steel material (base metal). Therefore, in regard to chemical components other than nitrogen, it is preferable to perform component analysis also from a ¼ sheet thickness position, and compare the result with a measurement result of component analysis of a sheet-thickness central portion. If the measurement results greatly differ, measuring spots of the sheet-thickness central portion may be further increased, or a measurement result of the ¼ sheet thickness position may be regarded as a measurement result of the average sheet-thickness central portion. To measure the components of the average sheet-thickness central portion, that is, the original components of the steel material (base metal), a method by emission spectral analysis described in JIS G1258 or the like is preferred to on-line analysis by EPMA. In this case, emission spectral analysis or the like is preferably performed on a cross-section (a cross-section perpendicular to a sheet thickness direction) of the sheet-thickness central portion (½t) or the like.

In the case where a sheet thickness is greater than 1.2 mm, a measurement result of a chemical composition of a portion that is at least 5 mm or more away from the sheared end face and at least 0.6 mm or more away from the surface may be regarded as a measurement result in the sheet-thickness central portion 5 mm or more away from the sheared end face. In addition, in the case where an analysis result of the chemical composition of the steel sheet used for the nitrided plate part can be checked according to a ladle analysis result or the like, the checked chemical composition including nitrogen content may be regarded as the chemical composition of the sheet-thickness central portion in the portion at least 5 mm or more away from the sheared end face.

Since the maximum intrusion depth of nitrogen due to gas softnitriding is 0.6 mm at maximum, a nitrided plate part with a sheet thickness of less than 1.2 mm may be affected by nitrogen that has intruded from front and back surfaces. In the sheet-thickness central portion, there is a large amount of segregation at a stage of steel sheet production, which serves as a starting point of a crack caused when the sheared end face of the nitrided plate part is caused to undergo out-of-plane deformation and brittle failure. Therefore, nitrogen content of the sheet-thickness central portion in the portion at least 5 mm or more away from the sheared end face has its range prescribed as described later as a basic requirement for a nitrided plate part, though it does not affect target fatigue the present invention. Note that the present invention is not limited to the above thickness; even if the sheet thickness is 1.2 mm or less, as long as nitrogen content of the sheet-thickness central portion in the portion at least 5 mm or more away from the shear plane is equal to or greater than 0.0007% and equal to or less than 0.0300% in mass, the sheet thickness may naturally be included in the scope of the present invention. In addition, the sheet thickness of the nitrided plate part need not be particularly limited, but a sheet thickness range may be set to equal to or greater than 1.0 mm and equal to or less than 8.0 mm, or greater than 1.2 mm and equal to or less than 6.0 mm. As necessary, a lower limit of the sheet thickness may be set to 1.2 mm or 1.5 mm. An upper limit of the sheet thickness may be set to 6.0 mm, 5.0 mm, or 3.8 mm.

Note that gas softnitriding treatment often treats a plurality of same parts in a furnace body; in the case where the parts are assumed to be affected by an atmosphere such as gas retention in the furnace, one or more of parts arranged at the outermost position in the furnace and one or more of parts arranged at the center may be extracted, the above-described nitrogen content of nitrided plate parts may be measured, and it may be determined whether a target value is reached in all the extracted nitrided plate parts. In the present invention, in the case where the term "nitrogen average content" is simply used, it indicates the above-described nitrogen average content of a nitrided plate part.

Figure 2:
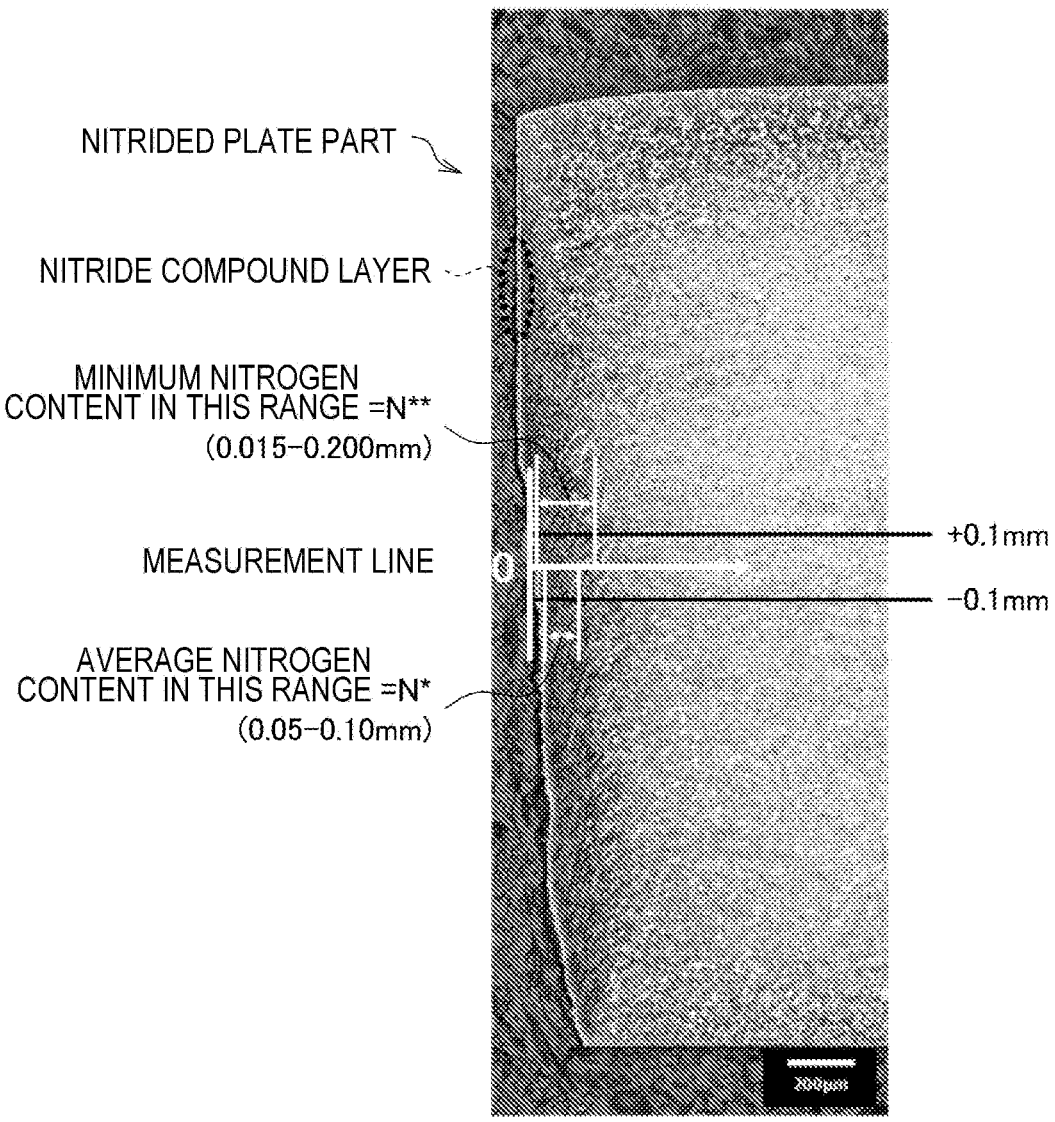
FIG. 2 is a microphotograph showing a cross-section of a measuring spot of a part having a round shape.

Here, for reference, FIGS. 1 and 2 show an example of a measuring area of a part having a round shape. FIG. 1 is an enlarged photograph of a round portion of a nitrided plate part having a round shape, and FIG. 2 is an enlarged photograph of a cut section of a cut portion shown in FIG. 1. As shown in FIG. 1, cutting may be performed in a normal direction to a ridge line of a sheared end face of the round portion, and in a range of sheet-thickness center±0.1 mm of the cross-section (the cut section shown in FIG. 2), nitrogen average content may be measured in a range of equal to or greater than 0.05 mm and equal to or less than 0.10 mm in depth from the sheared end face as point 0 in a plate interior direction, and minimum nitrogen content may be measured in a range of equal to or greater than 0.015 mm and equal to or less than 0.200 mm. Note that in the cross-sectional photograph in FIG. 2, nital corrosion is performed for viewability, but corrosion may not be performed in measurement by EPMA, as mentioned above. In addition, in FIG. 2, a white area observed in the entire surface layer is a nitride compound layer, and is excluded from a measurement range.

Figure 3:
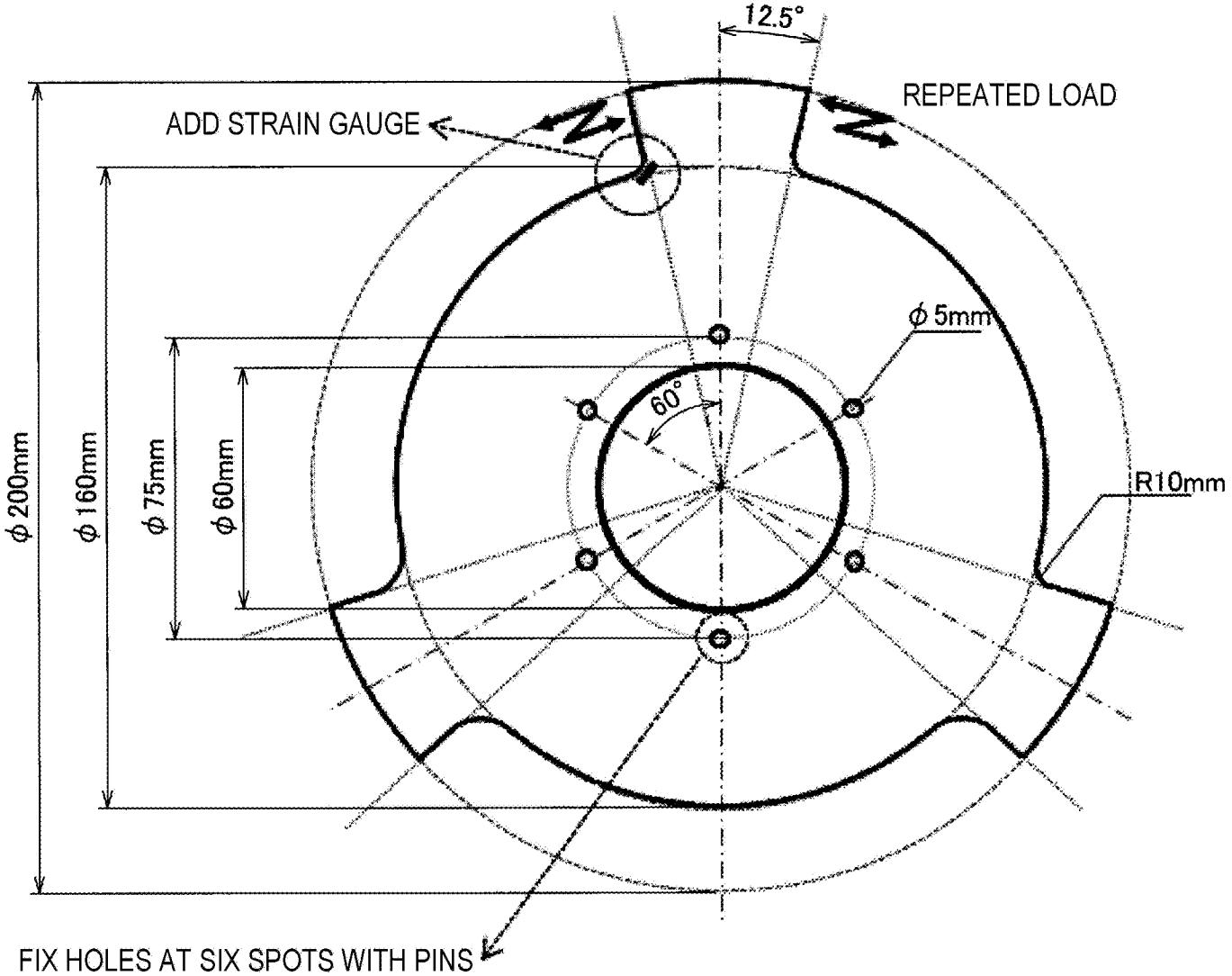
FIG. 3 is a front view of a test piece of a fatigue test.

Fatigue strength was evaluated by a method described below, and pass/fail was determined. That is, since a plate part used for a torque converter or the like, for example, is disposed perpendicularly to a rotation shaft when playing a role of power transmission, torque is applied in an in-plane direction of the plate. At this time, highest stress is applied to a sheared end face of the plate. For the purpose of reproducing such a load state, a fatigue test simulating out-of-plane deformation was performed using a test piece illustrated in FIG. 3. A sheet-thickness clearance management value in a pressing process is generally 15%, but shearing was performed with sheet-thickness clearance set to 20%, assuming that the influence of wear of a metal die, shaft misalignment, or the like brings about inferior sheared end face properties. Here, clearance in shearing indicates a gap between a die and a punch or a bit in shearing. In addition, sheet-thickness clearance is a value obtained by dividing this clearance by a sheet thickness.

In addition, the fatigue test was performed by applying load repeatedly at a frequency of 25 Hz and a stress ratio of −1, and a stress amplitude at $10^7$ cycles was found from a S—N curve. A fatigue amplitude at $10^7$ cycles is generally referred to as fatigue limit in some cases, but is referred to as fatigue strength in the present invention. As a stress value, a value measured with a strain gauge added to a position of "impart strain gauge" in FIG. 3 to be parallel to a tangent of the round portion was adopted. In addition, a distance from the sheared end face to the fatigue crack occurrence position is a value measured by observing, with a scanning electron microscope (SEM), a fatigue fracture obtained by applying a stress amplitude 20 MPa higher than fatigue strength to cause fatigue rupture, and indicates a distance from the fatigue crack occurrence position in a normal direction to the sheared end face.

Note that as fatigue failure test conditions for measuring a fatigue crack occurrence position, any stress amplitude value may be selected, as long as it is a stress amplitude such that number of cycles to failure is $10^5$ cycles or more. This is because at a stress amplitude such that number of cycles to failure is $10^5$ cycles or more, since stress is yield stress or less, the shape of the test piece does not change during the fatigue test, and the fatigue crack occurrence position does not change depending on stress amplitude.

An object of the present invention is to give rise to fatigue strength equivalent to or better than that of a carburized member. Hence, first, fatigue strength of a carburized plate reference part as a target is found. A pressed product fabricated using components of "Base" in Table 1 by a production method shown in Table 2 was held at a temperature of 910° C. for 270 minutes with an atmosphere adjusted to a range of 0.8 to 0.9 mass % in carbon potential, and then was subjected to oil cooling; thus, the carburized plate reference part was produced, which exhibited fatigue strength of 517 MPa. In the following description, this value was used as a threshold to decide pass/fail of fatigue strength

TABLE 1

| Material | Components (mass %) | | | | | | | | | | | |
|---|---|---|---|---|---|---|---|---|---|---|---|---|
| name | C | Si | Mn | P | S | Al | Ti | Nb | Cr | N | V | Mo |
| Try1 | 0.029 | 0.05 | 0.92 | 0.012 | 0.0032 | 0.25 | 0.034 | 0.001 | 0.192 | 0.0022 | 0.002 | 0.001 |
| Try2 | 0.045 | 0.05 | 0.78 | 0.011 | 0.0031 | 0.23 | 0.062 | 0.001 | 0.188 | 0.0032 | 0.003 | 0.001 |
| Try3 | 0.048 | 0.05 | 1.35 | 0.012 | 0.0023 | 0.24 | 0.061 | 0.001 | 0.190 | 0.0018 | 0.003 | 0.001 |
| Try4 | 0.047 | 0.04 | 1.36 | 0.012 | 0.0028 | 0.34 | 0.063 | 0.003 | 0.191 | 0.0042 | 0.003 | 0.001 |
| Try5 | 0.044 | 0.07 | 1.48 | 0.008 | 0.0023 | 0.18 | 0.056 | 0.011 | 0.291 | 0.0026 | 0.003 | 0.001 |
| Try6 | 0.048 | 0.07 | 0.95 | 0.011 | 0.0042 | 0.11 | 0.031 | 0.012 | 0.332 | 0.0027 | 0.003 | 0.002 |
| Try7 | 0.049 | 0.08 | 1.01 | 0.012 | 0.0029 | 0.26 | 0.088 | 0.013 | 0.152 | 0.0033 | 0.003 | 0.001 |
| Try8 | 0.103 | 0.05 | 1.13 | 0.008 | 0.0017 | 0.26 | 0.055 | 0.002 | 0.290 | 0.0044 | 0.002 | 0.001 |
| Try9 | 0.082 | 0.03 | 1.02 | 0.013 | 0.0022 | 0.13 | 0.035 | 0.015 | 0.121 | 0.0031 | 0.085 | 0.002 |
| Try10 | 0.034 | 0.02 | 1.01 | 0.014 | 0.0022 | 0.27 | 0.034 | 0.016 | 0.132 | 0.0020 | 0.004 | 0.123 |
| Try11 | 0.081 | 0.05 | 1.01 | 0.012 | 0.0030 | 0.25 | 0.036 | 0.013 | 0.133 | 0.0024 | 0.045 | 0.002 |
| Base | 0.110 | 0.08 | 1.25 | 0.008 | 0.0037 | 0.03 | 0.010 | 0.002 | 0.003 | 0.0030 | 0.001 | 0.001 |

| Material | Components (mass %) | | | | | | | | |
|---|---|---|---|---|---|---|---|---|---|
| name | B | Cu | Ni | W | Co | Ca | Mg | REM | Comparison |
| Try1 | 0.0001 | 0.01 | 0.01 | 0.00 | 0.00 | 0.0022 | 0.0005 | 0.0003 | invention |
| Try2 | 0.0001 | 0.02 | 0.01 | 0.00 | 0.00 | 0.0001 | 0.0001 | 0.0002 | invention |
| Try3 | 0.0002 | 0.01 | 0.00 | 0.00 | 0.00 | 0.0014 | 0.0003 | 0.0000 | invention |
| Try4 | 0.0002 | 0.04 | 0.02 | 0.00 | 0.00 | 0.0002 | 0.0000 | 0.0004 | invention |
| Try5 | 0.0001 | 0.00 | 0.02 | 0.01 | 0.00 | 0.0005 | 0.0003 | 0.0000 | invention |
| Try6 | 0.0001 | 0.02 | 0.01 | 0.00 | 0.00 | 0.0011 | 0.0004 | 0.0002 | invention |
| Try7 | 0.0001 | 0.01 | 0.02 | 0.00 | 0.00 | 0.0003 | 0.0006 | 0.0003 | invention |

TABLE 1-continued

| | | | | | | | | | |
|---|---|---|---|---|---|---|---|---|---|
| Try8 | 0.0001 | 0.02 | 0.01 | 0.00 | 0.00 | 0.0004 | 0.0011 | 0.0000 | invention |
| Try9 | 0.0001 | 0.06 | 0.07 | 0.00 | 0.00 | 0.0000 | 0.0002 | 0.0001 | invention |
| Try10 | 0.0028 | 0.02 | 0.01 | 0.00 | 0.01 | 0.0003 | 0.0000 | 0.0002 | invention |
| Try11 | 0.0017 | 0.01 | 0.01 | 0.02 | 0.00 | 0.0004 | 0.0001 | 0.0015 | invention |
| Base | 0.0001 | 0.01 | 0.01 | 0.00 | 0.00 | 0.0005 | 0.0001 | 0.0001 | reference |

TABLE 2

| Test number | Material name | Steel sheet coil name | FT (° C.) | t1 (sec) | CT (° C.) | t2 (sec) | Sheet thickness (mm) | Ferrite fraction (%) | Amount of plastic strain (%) | Coil recoiling after imparting strain | Ammonia gas Ratio (%) | Nitriding treatment temperature (° C.) | Treatment time (min) | Components status |
|---|---|---|---|---|---|---|---|---|---|---|---|---|---|---|
| 1 | Try1 | A | 889 | 2.8 | 524 | 21 | 1.36 | 45 | 0.05 | no | 50 | 546 | 150 | invention |
| 2 | Try2 | B | 891 | 2.6 | 531 | 22 | 1.42 | 54 | 0.04 | no | 50 | 565 | 150 | invention |
| 3 | Try3 | C | 911 | 2.1 | 543 | 21 | 1.4 | 32 | 0.04 | no | 50 | 571 | 120 | invention |
| 4 | Try4 | D | 920 | 1.8 | 556 | 21 | 1.62 | 32 | 0.05 | no | 50 | 573 | 90 | invention |
| 5 | Try5 | E | 909 | 1.9 | 543 | 22 | 5.42 | 29 | 0.05 | no | 50 | 568 | 90 | invention |
| 6 | Try6 | F | 934 | 2.1 | 541 | 24 | 1.81 | 46 | 0.04 | no | 50 | 564 | 150 | invention |
| 7 | Try7 | G | 897 | 2.0 | 520 | 21 | 4.53 | 52 | 0.04 | no | 50 | 559 | 150 | invention |
| 8 | Try8 | H | 953 | 2.1 | 531 | 27 | 3.22 | 48 | 0.03 | no | 50 | 582 | 90 | invention |
| 9 | Try9 | I | 912 | 1.9 | 541 | 24 | 2.3 | 38 | 0.04 | no | 50 | 572 | 90 | invention |
| 10 | Try10 | J | 889 | 2.8 | 551 | 22 | 2.61 | 26 | 0.03 | no | 50 | 551 | 90 | invention |
| 11 | Try11 | K | 934 | 2.9 | 521 | 26 | 2.92 | 27 | 0.03 | no | 50 | 573 | 120 | invention |
| 12 | Try1 | L | 921 | 2.7 | 590 | 21 | 1.39 | 61 | 0.00 | no | 50 | 551 | 150 | comparative |
| 13 | Try2 | M | 901 | 2.4 | 611 | 22 | 1.4 | 58 | 0.00 | no | 50 | 553 | 150 | comparative |
| 14 | Try3 | N | 901 | 2.0 | 489 | 21 | 1.44 | 28 | 3.15 | no | 50 | 575 | 120 | comparative |
| 15 | Try4 | O | 912 | 1.9 | 510 | 21 | 1.6 | 28 | 0.13 | no | 50 | 633 | 150 | comparative |
| 16 | Try5 | P | 892 | 1.9 | 503 | 22 | 5.43 | 22 | 0.11 | no | 50 | 625 | 120 | comparative |
| 17 | Try6 | Q | 911 | 1.9 | 543 | 24 | 1.79 | 44 | 0.05 | yes | 50 | 563 | 120 | comparative |
| 18 | Try7 | R | 867 | 1.8 | 504 | 21 | 4.5 | 43 | 0.12 | no | 50 | 432 | 150 | comparative |
| 19 | Try8 | S | 938 | 2.3 | 476 | 27 | 3.18 | 20 | 3.21 | no | 50 | 620 | 90 | comparative |
| 20 | Try9 | T | 895 | 2.2 | 489 | 24 | 2.32 | 25 | 3.43 | no | 50 | 583 | 90 | comparative |
| 21 | Try10 | U | 863 | 2.9 | 608 | 22 | 2.61 | 21 | 0.00 | no | 50 | 568 | 90 | comparative |
| 22 | Try11 | V | 945 | 2.7 | 471 | 26 | 2.93 | 20 | 3.09 | no | 50 | 574 | 90 | comparative |
| Comparison | Base | W | 920 | 2.3 | 603 | 17 | 2.02 | 65 | — | — | carburizing treatment: CP0.9 mass %, 910° C. × 270 min ⇒ O.Q | | | reference |

TABLE 3

| Test number | Material name | N* (mass %) | N** (mass %) | N amount at sheet-thickness center at position 5 mm away from sheared end face (mass %) | Fatigue strength σ w (MPa) | d (mm) | Components status |
|---|---|---|---|---|---|---|---|
| 1 | Try1 | 0.5204 | 0.2632 | 0.0023 | 543 | 0.30 | invention |
| 2 | Try2 | 0.5698 | 0.2340 | 0.0031 | 528 | 0.28 | invention |
| 3 | Try3 | 1.0600 | 0.1534 | 0.0017 | 543 | 0.23 | invention |
| 4 | Try4 | 0.9812 | 0.0897 | 0.0040 | 530 | 0.22 | invention |
| 5 | Try5 | 0.6211 | 0.0743 | 0.0027 | 521 | 0.22 | invention |
| 6 | Try6 | 0.7197 | 0.2230 | 0.0027 | 561 | 0.28 | invention |
| 7 | Try7 | 0.8798 | 0.2224 | 0.0030 | 542 | 0.26 | invention |
| 8 | Try8 | 1.1455 | 0.0732 | 0.0045 | 522 | 0.20 | invention |
| 9 | Try9 | 1.0812 | 0.0925 | 0.0032 | 536 | 0.21 | invention |
| 10 | Try10 | 0.4403 | 0.0937 | 0.0020 | 523 | 0.22 | invention |
| 11 | Try11 | 1.0775 | 0.1217 | 0.0024 | 539 | 0.22 | invention |
| 12 | Try1 | 0.3802 | 0.2233 | 0.0024 | 501 | 0.30 | comparative |
| 13 | Try2 | 0.3796 | 0.2324 | 0.0033 | 509 | 0.31 | comparative |
| 14 | Try3 | 1.3189 | 0.1673 | 0.0022 | 478 | 0.22 | comparative |
| 15 | Try4 | 1.1312 | 0.0541 | 0.0041 | 493 | 0.19 | comparative |
| 16 | Try5 | 0.9805 | 0.0254 | 0.0027 | 465 | 0.17 | comparative |
| 17 | Try6 | 0.3496 | 0.1901 | 0.0026 | 508 | 0.26 | comparative |
| 18 | Try7 | 0.3730 | 0.2726 | 0.0030 | 502 | 0.25 | comparative |

TABLE 3-continued

| Test number | Material name | N* (mass %) | N** (mass %) | N amount at sheet-thickness center at position 5 mm away from sheared end face (mass %) | Fatigue strength σ w (MPa) | d (mm) | Components status |
|---|---|---|---|---|---|---|---|
| 19 | Try8 | 1.4263 | 0.0241 | 0.0041 | 438 | 0.14 | comparative |
| 20 | Try9 | 1.3223 | 0.0623 | 0.0036 | 514 | 0.20 | comparative |
| 21 | Try10 | 0.3084 | 0.0824 | 0.0022 | 491 | 0.21 | comparative |
| 22 | Try11 | 1.3841 | 0.1122 | 0.0024 | 489 | 0.23 | comparative |
| Comparison | Base | — | — | — | — | 517 | reference |

Furthermore, test numbers 1 to 22 of Table 3 are nitrided plate parts prototyped using components (ladle analysis values of steel material) of Try1 to Try11 of Table 1 by production methods shown in Table 2, and fatigue test results of these are compared with fatigue strength of the carburized plate reference part. Note that except for test numbers 12, 13, 17, and 21, when each steel sheet coil was opened, the spot had a shape wavy in a width direction; thus, shearing was difficult to perform. Therefore, after the coil was uncoiled, bend/unbend leveling to achieve a predetermined amount of plastic strain was performed; thus, a nitrided plate part was prototyped. As will be described later, this process is closely related to N**, which is minimum nitrogen content in the range in which the distance from the sheared end face in the sheared end face normal direction is equal to or greater than 0.015 mm and equal to or less than 0.200 mm, and N*, which is nitrogen average content in the range in which the distance from the sheared end face in the sheared end face normal direction is equal to or greater than 0.05 mm and equal to or less than 0.10 mm. In the following description, what led up to treating N* and N** as requirements and reasons for limiting them are described first, and then the relationship between a production method, and N* and N** is described.

Note that the "N" content in Table 1 indicates an amount contained in a casting product or a slab. In addition, in each example, the balance is iron and unanalyzed impurities. In addition, in Tables 2 and 3, "FT" indicates hot finish rolling exit-side temperature (° C.), "t1" indicates time (second) from the end of hot finish rolling to the start of cooling, "CT" indicates cooling stop temperature (° C.), "t2" indicates time (second) from the end of hot finish rolling to the end of cooling (cooling stop), and "d" indicates a fatigue crack occurrence depth (mm).

As a result of studies by the inventors, in the case where the distance from the sheared end face to the fatigue crack occurrence position (hereinafter simply called fatigue crack occurrence position) was 0.200 mm or more, a case where fatigue strength of the nitrided plate part exceeded that of the carburized plate part was recognized. This is presumably because load stress was reduced by the fatigue crack occurrence position becoming deeper, so that fatigue strength was satisfied. In a nitrided plate part, nitrogen is anchored to a dislocation to increase fatigue crack occurrence critical stress. Therefore, the inventors studied whether it is possible to make the crack occurrence position greater than 0.200 mm by adjusting the amount of nitrogen at 0.200 mm or less.

Figure 4:
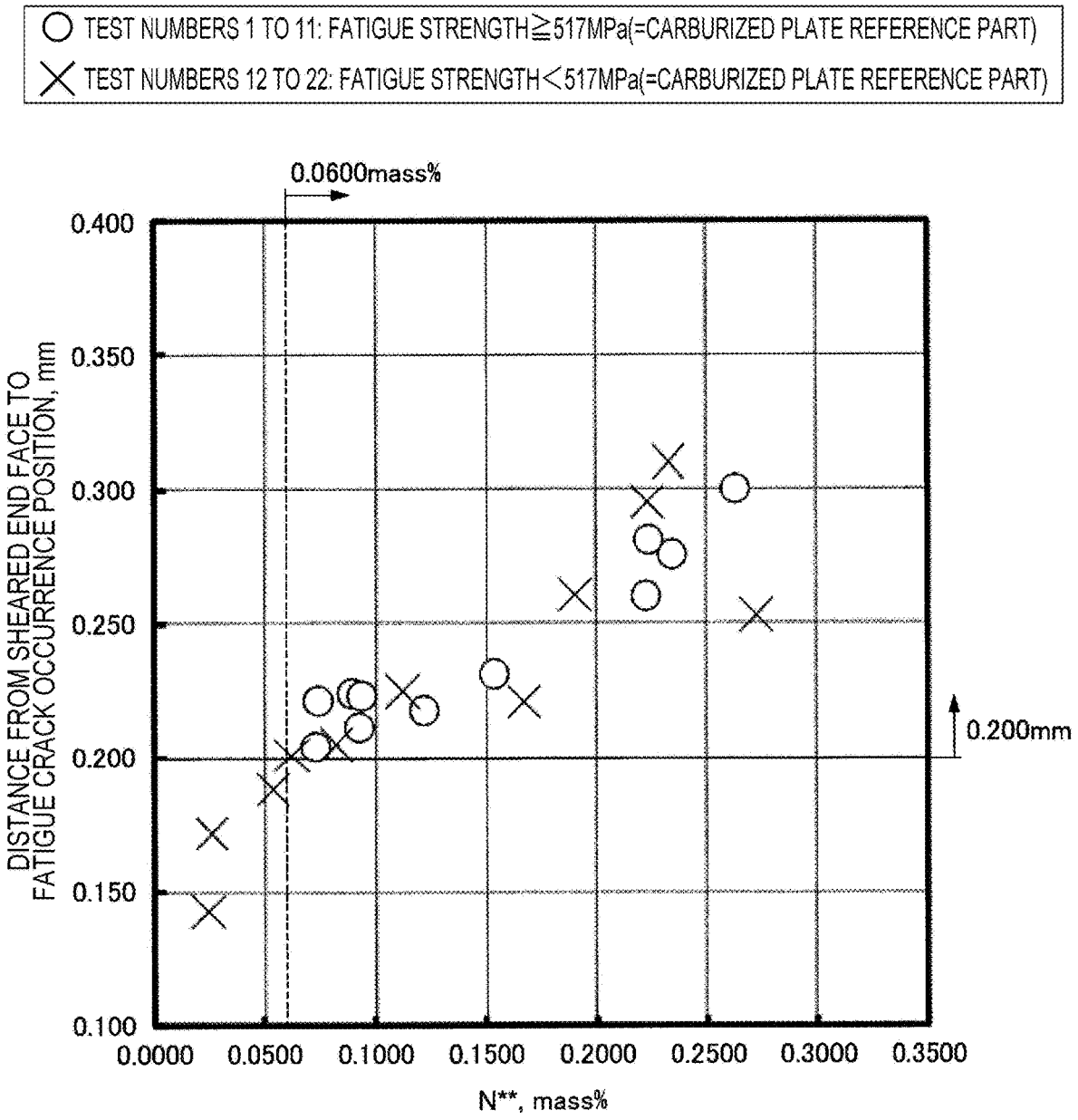
FIG. 4 is a graph showing the relationship between N** and a fatigue crack occurrence position.

FIG. 4 shows the relationship between the fatigue crack occurrence position, and N, which is minimum nitrogen content in a range in which the distance from the sheared end face in the sheared end face normal direction is 0.200 mm or less. In FIG. 4, "×" plots indicate samples that exhibited fatigue strength less than that of the carburized plate reference part, and "○" indicates samples that exhibited fatigue strength equal to or greater than that of the carburized plate reference part. According to FIG. 4, it was found that the fatigue crack occurrence position is uniquely determined by N and that if its value is set to 0.0600% or more in mass, the fatigue crack occurrence position can be controlled to 0.200 mm or more, and setting N** to 0.0600% or more in mass was found to be one of requirements for satisfying fatigue strength.

Requirements for satisfying fatigue strength were further studied. In a nitrided plate part, a fatigue crack occurs from an interior near the sheared end face. In the case where a fatigue crack occurs in the interior, occurrence of the fatigue crack cannot be recognized until it propagates to a free surface after occurrence. Therefore, propagation resistance of a fatigue crack may also have an influence on fatigue strength. Hence, the inventors studied whether it is possible to improve fatigue strength by controlling N*, which is nitrogen average content in a range very near to the sheared end face, that is, in the range in which the distance from the sheared end face in the sheared end face normal direction is equal to or greater than 0.05 mm and equal to or less than 0.10 mm, to a certain limitation range.

Study results of N* are described below.

In regard to samples that exhibited a difference in fatigue strength while satisfying N, SEM observation of a fatigue fracture was performed in a range from the sheared end face to the fatigue crack occurrence position. For the SEM observation, nitrided plate parts of test number 6 with the highest fatigue strength among samples that satisfied fatigue strength, test number 20 that satisfied N but slightly fell short of fatigue strength, and test number 4 with fatigue strength of 530 MPa were selected. Note that the fatigue rupture test was performed on the samples under the following conditions. In regard to the nitrided plate part prototyped as test number 6, 583 MPa was applied with a stress amplitude σa, and fatigue rupture was caused at $1.73\times10^6$ cycles. In regard to the nitrided plate part prototyped as test number 20, 534 MPa was applied with a stress amplitude σa, and fatigue rupture was caused at $2.65\times10^5$ cycles. In regard to the nitrided plate part prototyped as test number 4, 552 MPa was applied with a stress amplitude σa, and fatigue rupture was caused at $8.13\times10^5$ cycles.

Figure 5:
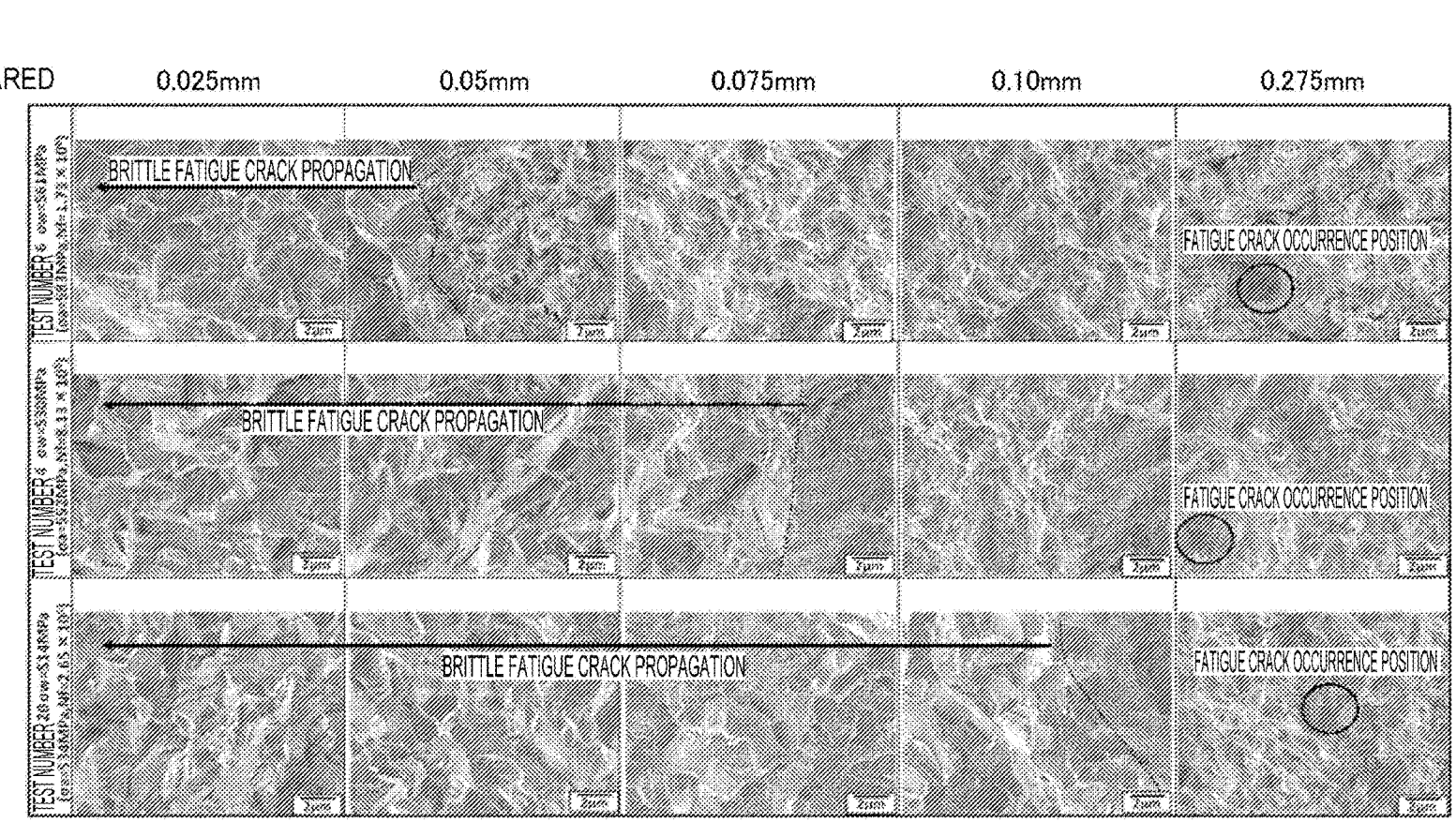
FIG. 5 is an image showing SEM observation results of fatigue fractures.

FIG. 5 shows the observation results. At the fatigue crack occurrence position, a typical fatigue fracture having striation was observed in each sample. However, a brittle fracture form was exhibited at less than 0.05 mm from the sheared end face, which applies to all the test pieces. This brittle fatigue fracture was recognized only in a range of less than 0.05 mm from the sheared end face in test number 6, and reached a range slightly exceeding 0.10 mm in test number 20 that slightly fell short of fatigue strength. In addition, in test number 4 with fatigue strength intermediate between test numbers 6 and 20, a brittle fatigue fracture was observed from a position of about 0.075 mm. According to these observation results, it is presumed that fatigue strength is determined by brittle fatigue crack propagation, and in particular, fatigue strength may be satisfied by suppressing a brittle fatigue crack propagation region to a range not exceeding 0.10 mm. Note that in a range of less than 0.05 mm, a brittle fatigue fracture is recognized regardless of whether fatigue strength is satisfied; thus, brittle fatigue crack propagation cannot be a factor for satisfying fatigue strength.

Also in the course of fatigue crack propagation, nitrogen presumably serves as resistance force. Hence, for the purpose of clarifying the relationship between average fatigue crack propagation resistance force in this region, that is, equal to or greater than 0.05 mm and equal to or less than 0.10 mm, and fatigue strength, the relationship between N* and fatigue strength was researched.

Figure 6:
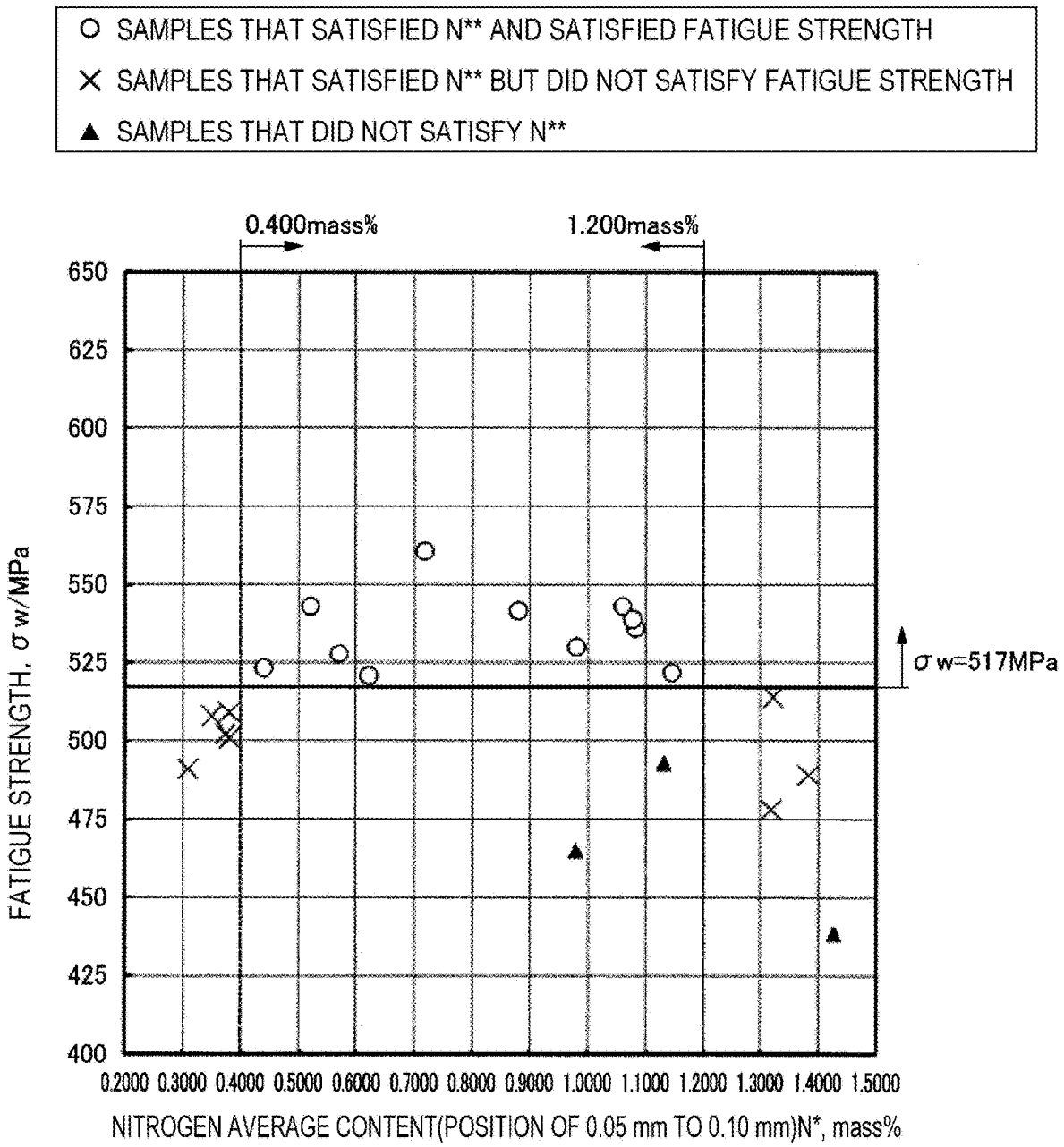
FIG. 6 is a graph showing the relationship between nitrogen average content and fatigue strength.

FIG. 6 shows the results. In FIG. 6, the results are plotted using "A" for samples that exhibited N not satisfying a requirement of 0.0600% or more, which is claimed in the present invention in regard to N, "×" for samples that exhibited N satisfying the requirement but did not satisfy fatigue strength, and "○" for samples that exhibited N satisfying the requirement and satisfied fatigue strength. First, in the case where N** did not satisfy the requirement, fatigue strength did not satisfy the target regardless of N*; this matches the aforementioned effect. On the other hand, up to N* of 0.4000% in mass, fatigue strength increased with an increase in N*. However, at N* of 1.2000% or more, a tendency was recognized in which fatigue strength decreased with an increase in N*. A lower limit value of N* is presumably a content necessary for giving rise to an effect provided by anchoring and suppressing transition to brittle fatigue crack propagation. On the other hand, it is presumed that in the case where N* was excessively high, high back stress was caused at the moment of release from anchoring, and a state in which a fatigue crack easily propagates was entered, resulting in transition to brittle propagation.

Figure 7:
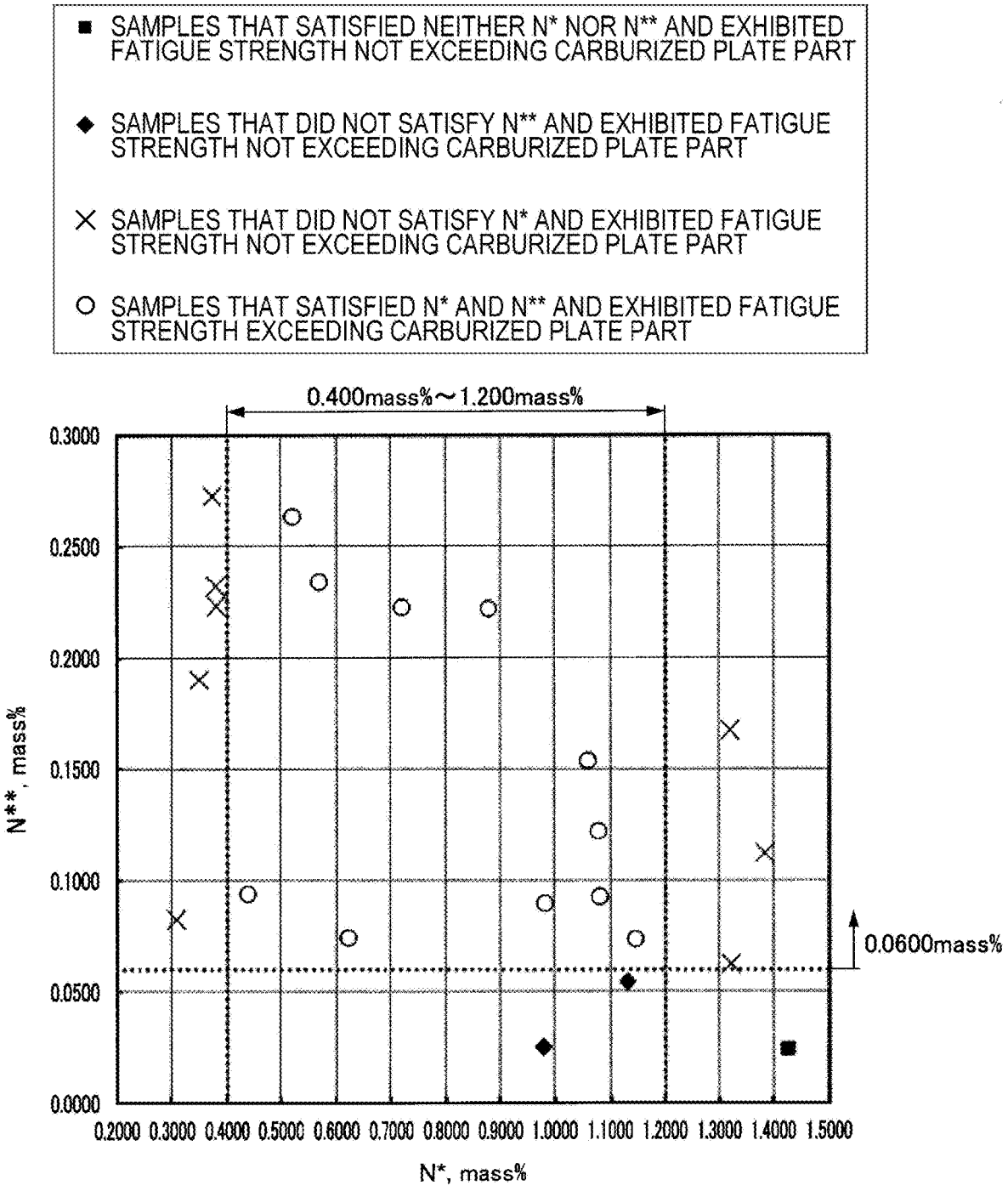
FIG. 7 is a graph showing the relationship between N* and N**, and fatigue strength.

According to the above studies, the relationship between N* and N, and fatigue strength shown in FIG. 7 was obtained. In FIG. 7, "◆" plots indicate samples that exhibited N of less than 0.0600% in mass and did not satisfy fatigue strength. "x" plots indicate samples that exhibited N** of 0.0600% or more but exhibited N* of less than 0.4000% or greater than 1.2000% and thus did not satisfy fatigue strength. In addition, "■" plots indicate samples that satisfied neither N* nor N** and did not satisfy fatigue strength. According to these results, it was found that by limiting N* to equal to or greater than 0.4000% and less than 1.2000% in mass and, furthermore, satisfying also N of 0.0600% or more in mass, it is possible to develop a nitrided plate part having fatigue strength equivalent to or better than that of a carburized plate part, which had seemed to be extremely difficult to achieve. Note that an upper limit of N need not be particularly prescribed, but approximately 0.7000% is the commonsense upper limit according to nitriding conditions etc. described later. In addition, a lower limit of N* may be set to 0.4500% or 0.5000%, and an upper limit of N* may be set to 1.1000% or 1.0000%. Moreover, a lower limit of N may be set to 0.0650%, 0.0700%, or 0.0800%, and an upper limit of N may be set to 0.5000% or 0.3000%

In addition, in a shear plane of a nitrided plate part, in the case where nitrogen content of the sheet-thickness central portion in the portion at least 5 mm or more away from the sheared end face, which is a region without nitrogen intrusion due to gas softnitriding treatment, exceeds 0.0300% in mass, the nitrided plate part is reduced in toughness, and does not function as a part. In addition, nitrogen content of the portion being less than 0.0007% in mass results in extremely high production cost in a steel sheet coil production process described later. According to these reasons irrelevant to fatigue strength, a requirement of nitrogen content of the sheet-thickness central portion in the portion at least 5 mm or more away from the sheared end face of equal to or greater than 0.0007% and equal to or less than 0.0300% in mass was set. A lower limit of nitrogen content of the sheet-thickness central portion in the portion at least 5 mm or more away from the sheared end face may be set to, in mass %, preferably 0.0010%, 0.0015%, or 0.0020%, and its upper limit, to 0.0200%, 0.0100%, or 0.0080%.

Obviously, the prescription related to nitrogen content of the sheet-thickness central portion in the portion at least 5 mm or more away from the sheared end face is applied also to nitrogen content of the steel sheet (base metal).

1.2 Steel Sheet Components Excluding Nitrogen

Next, reasons for limiting steel sheet components excluding nitrogen are described. In order to achieve compatibility between playing a role of power transmission and being lightweight, a nitrided plate part is generally required to have a tensile strength of at least 340 MPa or more. On the other hand, if ductility decreases (for example, if total elongation of JIS Z2241 No. 5 test piece is less than 13%), formability is impaired in a press-forming process, which is not suitable for industrial production. The present invention, in order to achieve compatibility between strength and ductility, premises the following component ranges. Note that selection elements may be contained in ranges described later for strength adjustment or the like.

Elements contained in a steel sheet used for a nitrided plate part of the present invention are described below.

C content: if C exceeds 0.113% in mass, strength increases, and also, formation of pearlite structure causes ductility to significantly decrease. Note that if C is less than 0.025%, strength is 340 MPa or less, so that the nitrided plate part does not function as a frame part in the first place. Note that if C increases, a peritectic range is entered and slab toughness may decrease; hence, the C content is preferably 0.10% or less or 0.09% or less. In addition, in order to obtain sufficient strength, the C content is 0.034% or more, 0.040% or more, or 0.045% or more.

Si content: this element increases strength as a solid solution strengthening element, but is preferably not added in the first place, because a pattern attributed to scale formed in a finish rolling process remains in the nitrided plate part to reduce wear resistance of the nitrided plate part. Note that the pattern appears in the case where 0.10% is exceeded in mass. A lower limit of the Si content need not be particularly prescribed, and the lower limit is 0%. However, since raw material cost increases at less than 0.01%, the Si content may be set to 0.01% or more. In addition, to make wear resistance more excellent, the Si content is preferably 0.08% or less.

P content: addition of greater than 0.020% in mass reduces press formability, bringing about many cases where a plate part cannot be produced, and also, reduces toughness of a slab and also reduces productivity of a steel sheet. Therefore, the P content is preferably as low as possible, and its lower limit is 0%. However, production cost of the steel sheet is extremely high at less than 0.001%. Therefore, the P content may be set to 0.001% or more. In addition, to sufficiently ensure plate formability and productivity of the steel sheet, the P content is preferably 0.015% or less or 0.013% or less.

S content: addition of greater than 0.0200% in mass causes a steel sheet containing a large amount of inclusions to be produced, resulting in significant forming rupture due to press-forming. Therefore, a low addition amount is preferable, and its lower limit is 0%. However, production cost of the steel sheet is extremely high at less than 0.0001%, so that an economical effect provided by the present invention may be lost. Therefore, the S content may be set to 0.0001% or more. To improve press-forming, the S content may be set to 0.0100% or less, 0.0050% or less, or 0.0030% or less.

Mn content: at less than 0.71% in mass, strength is less than 340 MPa, and if 1.49% is exceeded, ductility is significantly reduced by the influence of casting segregation. The Mn content may be set to 1.40% or less, 1.30% or less, or 1.25% or less in order to avoid formation of a structure elongated in a rolling direction due to Mn segregation, though it does not particularly have an adverse effect on performance of the nitrided plate part. To improve strength, the Mn content may be set to 0.75% or more, 0.80% or more, or 0.85% or more.

Ti content: if Ti exceeds 0.091% in mass, tensile strength of the steel sheet increases, so that ductility significantly decreases; hence, Ti is set to 0.091% or less. In addition, at Ti of less than 0.020%, the steel sheet does not exhibit strength of 340 MPa or more; hence, Ti is set to 0.020% or more. A lower limit of the Ti content may be set to 0.025% or 0.030%, and its upper limit, to 0.075% or 0.060%.

Nb content: addition of greater than 0.020% in mass increases tensile strength of the steel sheet and thus reduces ductility, and also, causes flaws to be formed on the surface in the finish rolling process; hence, Nb is set to 0.020% or less. Its lower limit is 0%, but 0.005% or more may be added in the case where fine grained structure is desired, though it does not have an influence on performance of the nitrided plate part. To improve ductility and prevent surface flaws, an upper limit of the Nb content may be set to 0.015% or 0.009%.

Cr content: this element is necessary for the nitrided plate part to have wear resistance, and 0.130% or more in mass needs to be added. On the other hand, at greater than 0.340%, ductility significantly decreases. Therefore, an upper limit of the Cr content is set to 0.340%. For an effect of wear resistance, the Cr content may be set to 0.180% or more, 0.200% or more, 0.210% or more, or 0.230% or more. To improve ductility, the Cr content may be set to 0.320% or less or 0.290% or less.

Al content: this element is a minimum necessary element for the nitrided plate part to have wear resistance, and 0.10% or more needs to be added. On the other hand, if 0.35% is exceeded, slab production cost is very high; hence, the Al content is set to 0.35% or less. To improve wear resistance, a lower limit of the Al content may be set to 0.14% or 0.18%. To reduce slab production cost, its upper limit may be set to 0.30% or 0.25%.

Furthermore, selection elements may be contained in the following ranges. These elements may be contained in a nitrided plate part for a predetermined purpose or as impurities. These selection elements are not required to be contained, and their lower limits are all 0%.

Mo content: this element is known as an element that improves wear resistance of a surface compound layer of the nitrided plate part, and may be added to the nitrided plate part of the present invention, but reduces toughness of a slab and impairs productivity in the case where 0.140% is exceeded. To improve toughness of the slab, its upper limit may be set to 0.100%, 0.050%, or 0.010%.

V content: this element is known as an element that improves wear resistance of a surface compound layer of the nitrided plate part, and may be added to the nitrided plate part of the present invention, but forms surface flaws in the finish rolling process described later and impairs productivity if 0.100% is exceeded in mass. To prevent surface flaws, its upper limit may be set to 0.050%, 0.030%, or 0.010%.

B content: this element may be added to improve formability when bending and flange forming are performed in the press-forming process, but its effect is saturated if 0.0030% is exceeded in mass. Therefore, the B content is set to 0.0030% or less. To improve formability, its upper limit may be set to 0.0020%, 0.0010%, or 0.0005%.

Cu content: Cu does not form a compound with another element, and is precipitated as Cu particles. However, these Cu particles are precipitated around 400° C., and thus have no influence on performance of the nitrided plate part. However, an excessive addition amount of Cu causes formation of flaws on the surface in a rough rolling process; hence, the addition amount is set to 0.13% or less. To prevent surface flaws, its upper limit may be set to 0.10% or 0.04%.

Ni content: Ni is an austenite former element, and in the case of being added excessively, reduces toughness of a nitrogen compound formed on the outermost surface of the plate part during nitriding treatment. Therefore, Ni is set to less than 0.08%. To improve toughness, its upper limit may be set to 0.05% or 0.03%.

W content: when molten steel containing W is solidified, W forms a eutectic structure with extremely high hardness, and reduces toughness of a casting product. For productivity, an addition amount of W is set to 0.07% or less. As necessary, an upper limit of W may be set to 0.02% or 0.005%.

Co content: as with W, when molten steel is solidified, Co forms a eutectic structure with extremely high hardness, and reduces toughness of a casting product. For productivity, an addition amount of Co is set to 0.07% or less. As necessary, an upper limit of W may be set to 0.02% or 0.005%.

Ca content: Ca is an element that makes nonmetallic inclusions finer and thus improves formability. However, if an addition amount of Ca is 0.007% or more, density of nonmetallic inclusions increases. In the case of using Ca, its addition amount is set to less than 0.007%. As necessary, an upper limit of Ca may be set to 0.004% or 0.001%.

Mg content: as with Ca, Mg is an element that makes nonmetallic inclusions finer and thus improves formability. However, if an addition amount of Mg is 0.005% or more, density of nonmetallic inclusions increases. In the case of using Mg, its addition amount is set to less than 0.005%. As necessary, an upper limit of Mg may be set to 0.002% or 0.0008%.

REM content: as with Ca and Mg, REM is an element that makes nonmetallic inclusions finer and thus improves formability. However, if an addition amount of REM is 0.005% or more, density of nonmetallic inclusions increases. In the case of using REM, its addition amount is set to less than 0.005%. As necessary, an upper limit of REM may be set to 0.002% or 0.0005%.

Here, "REM" refers to rare earth elements, more specifically Sc, Y, La, Ce, Pr, Nd, Pm, Sm, Eu, Gd, Tb, Dy, Ho, Er, Tm, Yb, and Lu, and any one or more of these may be contained in the nitrided plate part as REM. Note that the above REM content is total content of REM.

Note that in this specification, an impurity is a component that exists in steel regardless of an intention of addition, and originally need not exist in the obtained nitrided plate part. The term "impurity" is a concept including inevitable impurities that are mixed in from an ore or scrap serving as a raw material, a production environment, or the like in industrially producing a steel material. Such impurities may be contained in an amount that does not adversely affect an effect of the present invention.

1.3 Metal Structure

Next, a metal structure included in a nitrided plate part according to the present embodiment is described.

As a steel sheet used for production of a nitrided plate part, a steel sheet with a ferrite fraction of 70% or less in area ratio is used. A sufficiently low ferrite fraction can prevent occurrence of a wrinkle pattern on the surface of a pressed part due to yield elongation; hence, the ferrite fraction is set to 70% or less in the metal structure of the nitrided plate part. The ferrite fraction is preferably set to 65% or less, 60% or less, or 50% or less.

The aforementioned ferrite fraction indicates an area ratio of ferrite structure in a metal structure. The area ratio of the ferrite structure is a value measured in a test piece taken from a position away from the surface of the steel sheet by ¼ sheet thickness or the sheet-thickness center and subjected to nital corrosion after mirror polishing. This metal structure is photographed with an optical microscope at a magnification of equal to or greater than 200-fold magnification and equal to or less than 1000-fold magnification; images of three or more field of views may be taken at each sheet thickness position. For all the images, area ratios of ferrite occupying the metal structure are found, and an average value of the area ratios of ferrite in all the images is taken as the ferrite fraction of the steel sheet.

In addition, the metal structure of the nitrided plate part is a structure mainly including ferrite and bainite. Therefore, while the area ratio of ferrite is satisfied, a total area ratio of ferrite and bainite may be 50% or more, preferably 60% or more, or 65% or more. In addition to ferrite and bainite, pearlite, martensite, austenite, or the like may exist.

2. Method for Producing Nitrided Plate Part

Next, a method for producing a nitrided plate part according to the present invention is described. That is, limitation ranges are clarified in regard to a production method for controlling the aforementioned N* and N** to within target ranges. In the following description, reasons for limitation are described in regard to steel sheet components excluding nitrogen and a steel sheet production method, as ranges in which the nitrided plate part satisfies a minimum role as an industrial product, and then, a production method for controlling nitrogen content to limitation ranges is described in detail.

A method for producing a nitrided plate part according to the present invention includes:

obtaining a steel sheet by performing hot rolling at hot finish rolling exit-side temperature in a range of equal to or greater than 850° C. and less than 960° C. on a slab having a chemical composition consisting of, in mass %, C: equal to or greater than 0.025% and equal to or less than 0.113%, Si: 0.10% or less, Mn: equal to or greater than 0.71% and equal to or less than 1.49%, P: 0.020% or less, S: 0.0200% or less, Ti: equal to or greater than 0.020% and equal to or less than 0.091%, Cr: equal to or greater than 0.130% and equal to or less than 0.340%, Al: equal to or greater than 0.10% and equal to or less than 0.35%, N: equal to or greater than 0.0007% and equal to or less than 0.0100%, Nb: equal to or greater than 0% and equal to or less than 0.020%, Mo: equal to or greater than 0% and equal to or less than 0.140%, V: equal to or greater than 0% and equal to or less than 0.100%, B: equal to or greater than 0% and equal to or less than 0.0030%, Cu: equal to or greater than 0% and equal to or less than 0.13%, Ni: equal to or greater than 0% and less than 0.08%, W: equal to or greater than 0% and equal to or less than 0.07%, Co: equal to or greater than 0% and equal to or less than 0.07%, Ca: equal to or greater than 0% and less than 0.007%, Mg: equal to or greater than 0% and less than 0.005%, REM: equal to or greater than 0% and less than 0.005%, and the balance: Fe and impurities;

then starting cooling within three seconds from an end of hot finish rolling, and cooling the steel sheet to equal to or greater than 460° C. and equal to or less than 630° C. within 29 seconds from the end of hot finish rolling;

coiling the steel sheet into a steel sheet coil;

in regard to the steel sheet coil further subjected to pickling, uncoiling the steel sheet coil, and then applying bending/unbending in a range of equal to or greater than 0.03% and equal to or less than 3.00% in amount of plastic strain to the steel sheet;

performing shearing and press-forming to make the steel sheet into a plate part shape, without recoiling the steel sheet again; and nitriding the steel sheet by causing the steel sheet to stay in a closed furnace adjusted to a temperature of equal to or greater than 500° C. and less than 620° C. with an atmosphere in which a volume constituent ratio of ammonia gas is greater than 30%, for a time of 60 minutes or more.

Hereinafter, reasons for limiting production conditions of a steel sheet coil will be described. That is, as with the setting of limitation ranges of components, in order to achieve compatibility between strength and ductility, conditions of hot rolling in a steel sheet coil production method, except for imparting of plastic strain to a surface layer of the steel sheet, subsequent recoiling/no recoiling, and nitriding conditions, which are described later, premise the following condition ranges so as not to adversely affect production of a nitrided plate part. Note that reasons for limiting a chemical composition of a slab are similar to the reasons for limiting the chemical composition in base metal of the nitrided plate part described above; thus, description is omitted.

2.1 Hot Rolling and Cooling

First, a slab is subjected to hot rolling at hot finish rolling exit-side temperature in a range of equal to or greater than 850° C. and less than 960° C.; thus, a steel sheet is obtained. Here, if the hot finish rolling exit-side temperature is greater than 960° C., slab deformation resistance at high temperature increases, making load of a rolling mill roll at the time of finish rolling extremely high, which is not suitable for industrial production. On the other hand, if the hot finish rolling temperature is 850° C. or less, crystal grains are coarse, which causes a decrease in ductility of the steel sheet. The hot finish rolling exit-side temperature is preferably 885° C. or more or 895° C. or more. In addition, the hot finish rolling exit-side temperature is preferably less than 950° C. or less than 940° C.

Then, cooling is started within three seconds from after hot finish rolling. In the case where time from after finish rolling to the start of cooling exceeds three seconds, crystal grains are coarse, which causes a decrease in ductility of the steel sheet, resulting in elongation of less than 13%.

In addition, in the cooling, the steel sheet is cooled to equal to or greater than 460° C. and equal to or less than 630° C. within 29 seconds from after hot finish rolling. Here, if the cooling stop temperature is less than 460° C., strength of the steel sheet significantly increases and ductility further decreases, resulting in elongation of less than 13% at worst. The cooling stop temperature is preferably 490° C. or more, more preferably 510° C. or more. On the other hand, if the cooling stop temperature is greater than 630° C., the ferrite fraction is greater than 70%, which brings about occurrence of yield point elongation and thus causes wrinkles, and also, crystal grains are coarse, which causes a further decrease in ductility of the steel sheet, resulting in elongation of less than 13% at worst. In addition, a cooling stop temperature of 630° C. or less can sufficiently reduce the ferrite fraction of the obtained steel sheet. The cooling stop temperature is preferably 590° C. or less, more preferably 560° C. or less.

Furthermore, in the case where time from the end of hot rolling to the end of cooling exceeds 29 seconds, crystal grains are coarse, which causes a further decrease in ductility of the steel sheet, resulting in less than 13% at worst. Time from after finish rolling to the cooling stop temperature is preferably 25 seconds or less, more preferably 22 seconds or less.

After that, the obtained steel sheet is coiled.

2.2 Bending/Unbending, and Shearing and Press-Forming

Then, in regard to a steel sheet coil subjected to pickling, the steel sheet coil is uncoiled, and then the steel sheet is subjected to bending/unbending in a range of equal to or greater than 0.03% and equal to or less than 3.00% in amount of plastic strain, and the steel sheet is subjected to shearing and press-forming without being recoiled again, to have a plate part shape. Hereinafter, in regard to a method for producing a nitrided plate part using the aforementioned steel sheet coil, detailed description will be given on a process necessary for controlling N* and N**, which are requirements of the present invention, to limitation ranges, and the limitation ranges.

In the course of clarifying the aforementioned requirements of N* and N**, test numbers 12, 13, 17, and 21 of Tables 2 and 3 were all not subjected to bend/unbend leveling. These exhibited N* not satisfying the lower limit value, and did not satisfy fatigue strength, without exception. On the other hand, test numbers 14, 19, 20, and 22, which exhibited extremely poor shapes and were subjected to strong strain by bend/unbend leveling, all exhibited high N*.

Hence, the influence of an amount of plastic strain in the aforementioned bending/unbending process was researched. In conducting the research, steel sheet coils O, Q, and T in Table 1 were used; the steel sheet coils were uncoiled, and subjected to bending/unbending deformation with different roll diameters, so that the amount of plastic strain was changed. Here, in measuring plastic strain, a 2-mm lattice pattern is drawn on the surface layer of the steel sheet in advance, and nominal strain is measured from a change in shape of the lattice pattern between before and after bending/unbending deformation; this strain is an amount brought about by permanent deformation; hence, this is adopted as it is as the amount of plastic strain. Samples subjected to the predetermined amount of plastic strain and then recoiled as steel sheet coils again were tested as well.

Figure 8:
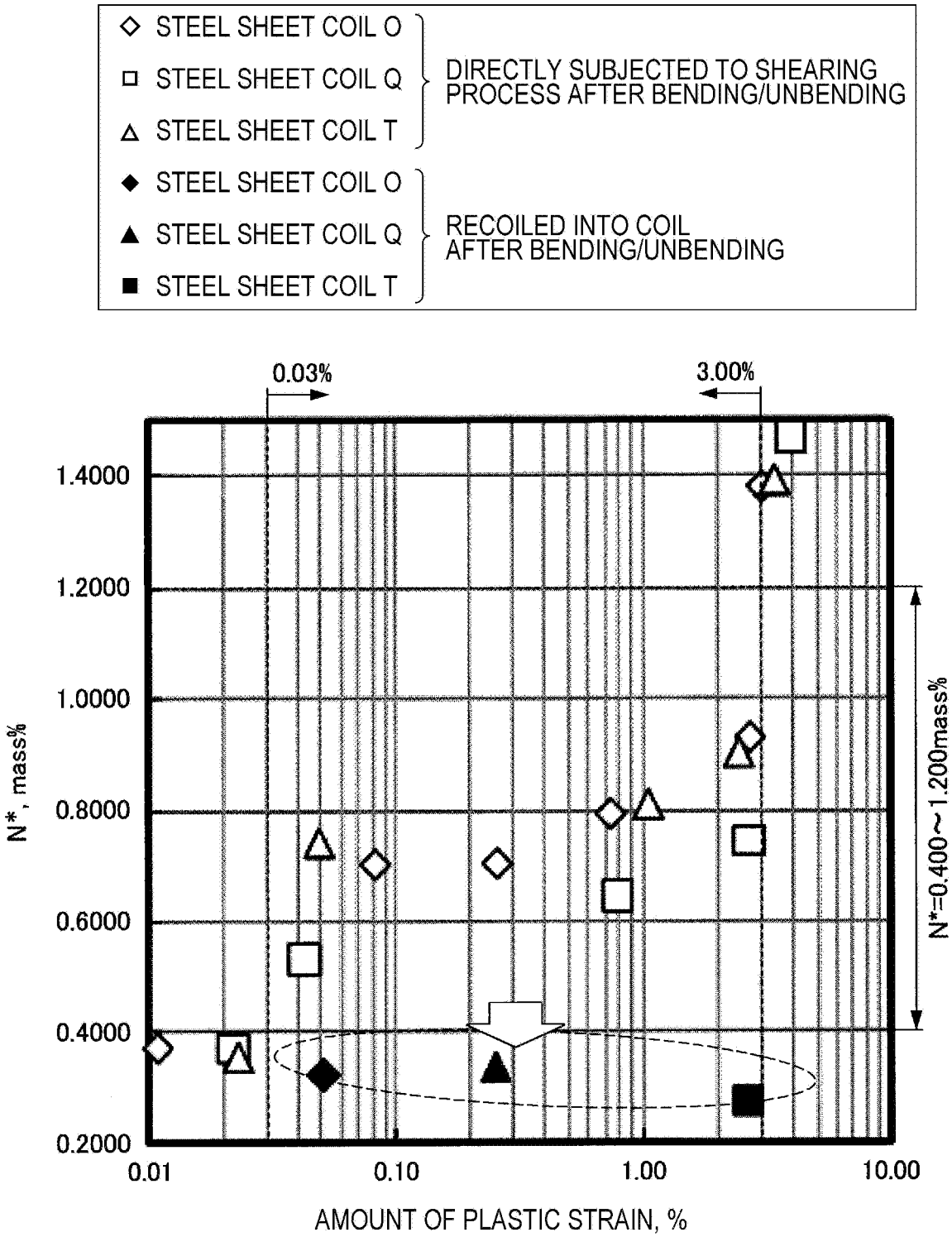
FIG. 8 is a graph showing the influence of an amount of plastic strain on N*.

FIG. 8 shows the influence of an amount of plastic strain on N*. Open symbols in FIG. 8 indicate samples that were subjected to predetermined plastic strain in a leveler process and then directly proceeded to a shearing process. In addition, solid symbols indicate samples that were subjected to predetermined plastic strain in the bending/unbending process and then, after the steel sheets were recoiled into coils again and the steel sheet coils were uncoiled again, directly proceeded to the shearing process. Note that in regard to each sample in FIG. 8, gas softnitriding treatment was performed under the following conditions: a volume constituent ratio of ammonia was 50%, temperature was 560 to 575° C., and treatment time was 90 to 150 minutes. In addition, samples that were subjected to predetermined plastic strain in the bending/unbending process and then directly proceeded to the shearing process exhibited N* exceeding 1.20% in mass when the amount of plastic strain exceeded 3.0%; this result is not dependent on the steel sheet coil. On the other hand, N* was less than 0.4000% in mass when the amount of plastic strain was less than 0.03%. Note that samples of which steel sheets were recoiled into coils again after being subjected to plastic strain exhibited N* of less than 0.4000%, regardless of the amount of plastic strain.

Figure 9:
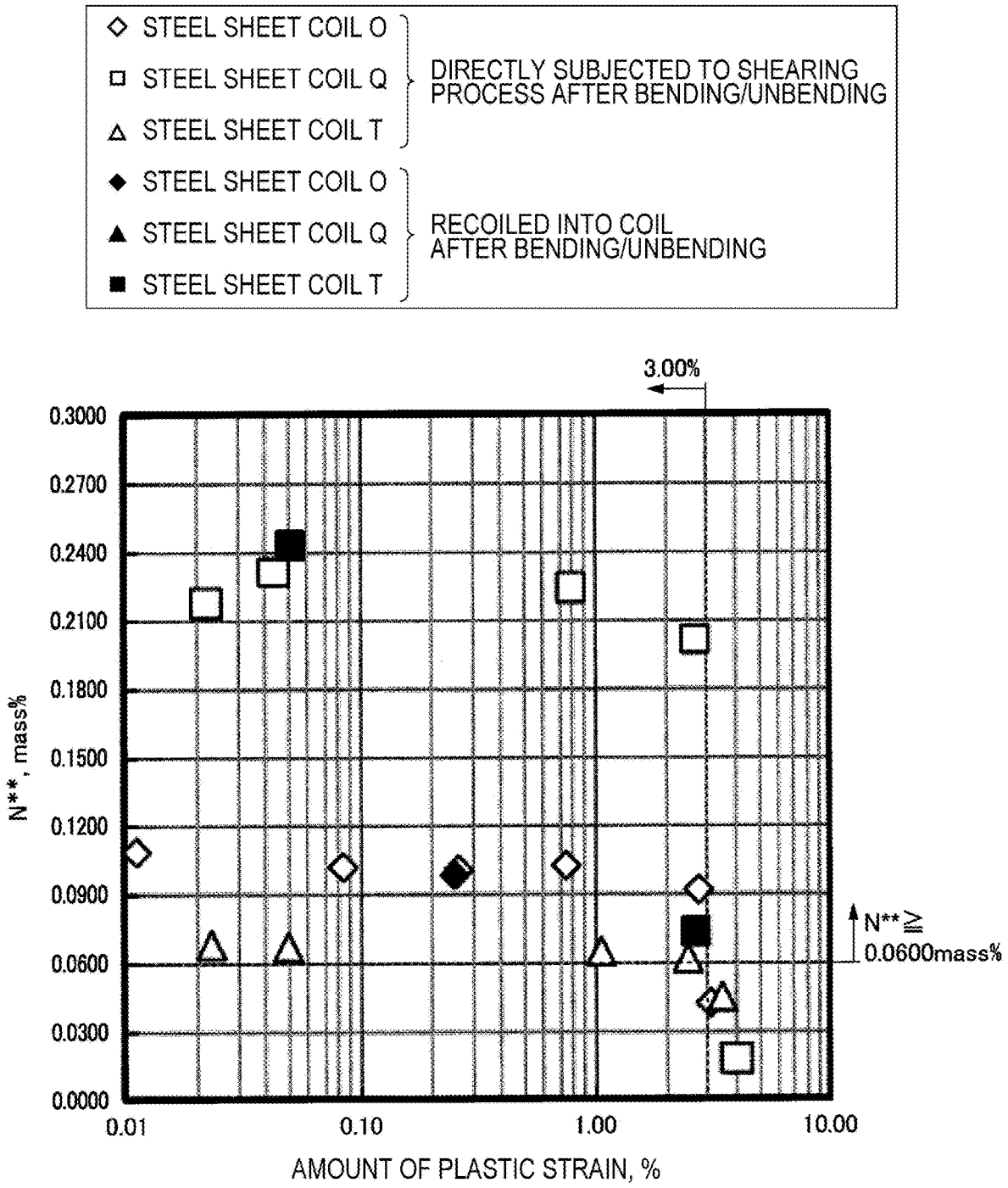
FIG. 9 is a graph showing the influence of plastic strain on N**.

Next, FIG. 9 shows the influence of plastic strain on N. Also in regard to each sample in FIG. 9, gas softnitriding treatment was performed under the following conditions: a volume fraction of ammonia was 50%, temperature was 560 to 575° C., and treatment time was 90 to 150 minutes. In FIG. 9, N was less than 0.0600% in mass when plastic strain exceeded 3.00%. The results showed no difference in N** between samples that were subjected to predetermined plastic strain in the bending/unbending process and then directly proceeded to the shearing process, and other samples. These results are presumably a phenomenon attributed to a dislocation state of the steel sheet coil. That is, in the case where plastic strain is high, frequency of sessile dislocations is high, and nitrogen excessively intrudes into the surface layer and is caused to stay during gas softnitriding. On the other hand, in the case where plastic strain is low or in the case where the steel sheet is recoiled into a coil again, a state in which a moving dislocation is introduced is entered. At this time, an atom vacancy in the steel sheet is consumed by not nitrogen but climb of the moving dislocation; this seems to have inhibited intrusion of nitrogen. Note that although it is extremely difficult to distinguish between a moving dislocation and a sessile dislocation, the dislocation state is unique to the amount of plastic strain; hence, the following limitation condition was set: the steel sheet is subjected to bending/unbending in a range of equal to or greater than 0.03% and equal to or less than 3.00% in amount of plastic strain, and then the steel sheet is subjected to shearing and press-forming without being recoiled again, to have a plate part shape.

Note that N* in a range in which the amount of plastic strain is equal to or greater than 0.05% and equal to or less than 1.50% is substantially constant, regardless of the amount of plastic strain. In industrial production, the amount of plastic strain is preferably set to equal to or greater than 0.05% and equal to or less than 1.50% in terms of production management.

Incidentally, in a steel sheet production process, skin pass rolling for removing yield elongation is performed in some cases. In this process, rolling is performed for the purpose of introducing plastic strain into the steel sheet. At this time, the amount of plastic strain is extremely small so as not to remove ductility of the steel sheet. In such skin pass, a predetermined amount of plastic strain is obtained by adjusting roll reduction and tension in a sheet longitudinal direction. That is, the steel sheet undergoes deformation such that a position immediately under reduction matches a position that is elongated. Therefore, the vicinity of the surface undergoes strong friction, and the vicinity of the surface layer exhibits peculiar dislocation distribution. As an invention using this, Patent Literature 3 discloses an example in which fatigue strength is improved by controlling dislocation density distribution at 50 μm from the surface layer and making a steel sheet composition adequate to make the maximum intrusion depth of nitrogen deeper. To check whether a similar mechanism contributes also in the bending/unbending process described above, the inventors researched a ratio of dislocation density between within 50 μm from the steel sheet surface before nitriding treatment in the sheet thickness direction, and a ¼ position in the sheet thickness direction, by a method described in Patent Literature 3. The results are shown in Table 4. The results showed a change in dislocation density ratio due to the amount of plastic strain in the bending/unbending process, but a dislocation density ratio of 2.0 times or more was not able to be obtained. This is presumably because the bending/unbending process described above does not involve roll reduction and accompanying friction.

That is, the feature of dislocation density of Patent Literature 3 was not obtained presumably because skin pass rolling satisfying a reduction ratio of equal to or greater than 0.5% and equal to or less than 5% and F/T≥80000 was not performed. Note that the "F" indicates line load (Kg/mm) obtained by dividing rolling mill load by a sheet width of the steel sheet, and the "T" indicates load per unit area (Kg/mm$^2$) applied in a longitudinal direction of the steel sheet.

Since sufficient fatigue strength is thus satisfied even if the dislocation density ratio is less than 2.0 times, it can be said that an improvement in fatigue strength of the nitrided plate part in the present invention is not attributed to dislocation density of the steel sheet. Furthermore, the technique described in Patent Literature 3 is a method of controlling a maximum hardening depth, but cannot control N**, which is the point of the present invention. This is because as dislocation density in the vicinity of the surface layer is higher, more nitrogen is accumulated in the vicinity of the surface layer, and the amount of nitrogen diffused from the surface layer to a deeper position is reduced. Therefore, fatigue strength of a nitrided plate part cannot be satisfied in the first place.

In addition, shearing and press-forming are not particularly limited, and can be performed as appropriate by methods known by a person skilled in the art.

2.3 Gas Softnitriding Treatment

Lastly, the steel sheet having been subjected to shearing and press-forming is nitrided by being caused to stay in a closed furnace adjusted to a temperature of equal to or greater than 500° C. and less than 620° C. with an atmosphere in which a volume constituent ratio of ammonia gas is greater than 30%, for a time of 60 minutes or more. In this manner, a nitrided plate part can be obtained.

Hereinafter, description will be given on reasons for limiting gas softnitriding treatment conditions satisfying nitrogen content of a nitrided plate part. First, in the case where gas softnitriding treatment is performed in an atmosphere in which the volume constituent ratio of ammonia gas is 30% or less, nitrogen supplied to a pressed part is reduced, and N* does not satisfy 0.4000% or more in mass, and also, N** does not satisfy 0.0600% or more in mass. The volume constituent ratio of ammonia gas in the atmosphere may be greater than 30%, but is preferably 40% or more. In addition, the volume constituent ratio of ammonia gas in the atmosphere is preferably 65% or less, preferably 55% or less.

In addition, if treatment temperature is less than 500° C., a decomposition reaction of ammonia gas is suppressed, and N* does not satisfy 0.4000% or more. On the other hand, a treatment temperature of 620° C. or more makes growth of a surface compound layer predominant, and consequently N** does not satisfy 0.0600% or more in mass. Treatment temperature is preferably 520° C. or more, more preferably 540° C. or more. In addition, treatment temperature is preferably 600° C. or less, more preferably 580° C. or less.

Furthermore, if nitriding treatment time is less than 60 minutes, diffusion time is short and N does not satisfy 0.0600% or more in mass. Note that longer treatment time can increase N, but increases cost of gas softnitriding treatment. A range of 270 minutes or less is preferable, in which case compatibility between economic efficiency and durability of a gas-softnitrided plate part can be achieved. In addition, treatment time may be 60 minutes or more, but is preferably 90 minutes or more.

The above are features of a product of the present invention and reasons for limiting a production method.

EXAMPLES

Next, Examples of the present invention are described. Note that Examples shown below are merely examples of the present invention, and the present invention is not limited to Examples below.

Nitrided plate parts with the shape in FIG. 1 were prototyped using slabs with component ranges of Try1 to Try11 shown in Table 1, by production methods shown in Table 4. Note that in Tables 4 and 5, "Q", "O", and "T" are the same steel sheet coils as "Q", "O", and "T" in Tables 2 and 3; only positions in a longitudinal direction of the steel sheets used for producing the nitrided plate parts are different. Therefore, cooling stop temperature (CT) slightly differs from that in Tables 2 and 3. In a fatigue test of the prototyped nitrided plate parts, load was applied repeatedly at a frequency of 25 Hz and a stress ratio of 1, and a stress amplitude that did not cause rupture up to $10^7$ cycles was defined as fatigue strength. A strain gauge was added in a circumferential direction at the gray position in FIG. 3, and measured values were adopted as stress values. The results are shown in Table 5. Note that symbols in Tables 4 and 5 denote meanings similar to those of the symbols in Tables 2 and 3. In addition, a threshold for pass/fail is the aforementioned fatigue strength of 517 MPa or more.

The "nitrogen amount of the sheet-thickness central portion in the portion at least 5 mm or more away from the sheared end face" as a region without nitrogen intrusion due to gas softnitriding treatment was measured as follows: any three spots were subjected to measurement of nitrogen content at three spots at intervals of 0.003 mm from a sheet-thickness central portion in a portion 5 mm away from the sheared end face in the normal direction as an origin point along a sheet-thickness central line, and an average value of the measurement results was entered in Table 5. Besides this measurement of nitrogen content, analysis of a chemical composition was not performed in regard to a position 5 mm or more away from the surface of the nitrided plate part including the sheared end face, as a region without nitrogen intrusion due to gas softnitriding treatment; ladle analysis results of steel materials used in Table 1 were regarded as chemical composition analysis results at the position 5 mm or more away from the surface. Ladle analysis values of nitrogen content of the steel materials in Table 1 are substantially the same as analysis values of nitrogen content of the nitrided plate parts in Table 3.

TABLE 4

| Test number | Material name | Steel sheet coil name | FT (° C.) | t1 (sec) | CT (° C.) | t2 (sec) | Sheet thickness (mm) | Ferrite fraction (%) | Amount of plastic strain (%) | Coil recoiling after imparting strain | Dislocation density ratio | Ammonia gas ratio (%) | Nitriding treatment temperature (° C.) | Treatment time (min) | Components status |
|---|---|---|---|---|---|---|---|---|---|---|---|---|---|---|---|
| 23 | Try4 | O | 912 | 1.9 | 562 | 21 | 1.59 | 43 | 0.01 | no | 1.01 | 50 | 573 | 90 | comparative |
| 24 | | | | | | | | | 0.06 | no | 1.12 | 50 | 573 | 90 | invention |
| 25 | | | | | | | | | 0.26 | no | 1.26 | 50 | 573 | 90 | invention |
| 26 | | | | | | | | | 0.75 | no | 1.54 | 50 | 573 | 90 | invention |
| 27 | | | | | | | | | 2.75 | no | 1.75 | 50 | 573 | 90 | invention |
| 28 | | | | | | | | | 3.08 | no | 1.82 | 50 | 573 | 90 | comparative |
| 29 | | | | | | | | | 0.25 | yes | 1.23 | 50 | 573 | 90 | comparative |
| 30 | Try6 | Q | 911 | 1.9 | 590 | 24 | 1.83 | 61 | 0.02 | no | 1.01 | 50 | 560 | 150 | comparative |
| 31 | | | | | | | | | 0.04 | no | 1.1 | 50 | 560 | 150 | invention |
| 32 | | | | | | | | | 0.78 | no | 1.52 | 50 | 560 | 150 | invention |
| 33 | | | | | | | | | 2.69 | no | 1.67 | 50 | 560 | 150 | invention |
| 34 | | | | | | | | | 3.98 | no | 1.84 | 50 | 560 | 150 | comparative |
| 35 | | | | | | | | | 0.05 | yes | 1.05 | 50 | 560 | 150 | comparative |
| 36 | Try9 | T | 895 | 2.2 | 610 | 24 | 2.31 | 68 | 0.02 | no | 1.02 | 50 | 572 | 90 | comparative |
| 37 | | | | | | | | | 0.05 | no | 1.07 | 50 | 572 | 90 | invention |
| 38 | | | | | | | | | 1.05 | no | 1.51 | 50 | 572 | 90 | invention |
| 39 | | | | | | | | | 2.47 | no | 1.72 | 50 | 572 | 90 | invention |
| 40 | | | | | | | | | 3.45 | no | 1.89 | 50 | 572 | 90 | comparative |
| 41 | | | | | | | | | 2.66 | yes | 1.81 | 50 | 572 | 90 | comparative |
| 42 | Try1 | A | 889 | 2.8 | 524 | 21 | 1.34 | 45 | 0.14 | no | 1.14 | 20 | 589 | 180 | comparative |
| 43 | Try2 | B | 891 | 2.6 | 531 | 22 | 1.42 | 54 | 0.14 | no | 1.13 | 30 | 593 | 180 | comparative |
| 44 | Try3 | C | 911 | 2.1 | 543 | 21 | 1.41 | 32 | 0.14 | no | 1.11 | 50 | 571 | 50 | comparative |
| 45 | Try4 | D | 920 | 1.8 | 556 | 21 | 1.62 | 32 | 0.14 | no | 1.11 | 40 | 573 | 60 | invention |
| 46 | Try5 | E | 909 | 1.9 | 543 | 22 | 5.42 | 29 | 0.15 | no | 1.08 | 50 | 568 | 180 | invention |
| 47 | Try6 | F | 934 | 2.1 | 541 | 24 | 1.83 | 46 | 0.15 | no | 1.21 | 50 | 564 | 240 | invention |
| 48 | Try7 | G | 897 | 2.0 | 520 | 21 | 4.55 | 52 | 0.15 | no | 1.09 | 50 | 559 | 270 | invention |
| 49 | Try8 | H | 953 | 2.1 | 531 | 27 | 3.23 | 48 | 0.14 | no | 1.12 | 50 | 494 | 240 | comparative |
| 50 | Try9 | I | 912 | 1.9 | 541 | 24 | 2.28 | 38 | 0.15 | no | 1.08 | 50 | 624 | 90 | comparative |
| 51 | Try10 | J | 889 | 2.8 | 551 | 22 | 2.6 | 26 | 0.15 | no | 1.08 | 50 | 608 | 180 | invention |
| 52 | Try11 | K | 934 | 2.9 | 521 | 26 | 2.91 | 27 | 0.15 | no | 1.12 | 50 | 516 | 150 | invention |
| 53 | Try5 | E | 909 | 1.9 | 543 | 22 | 5.41 | 29 | 0.15 | yes | 1.14 | 50 | 568 | 180 | comparative |
| 54 | Try10 | J | 889 | 2.8 | 551 | 22 | 2.58 | 26 | 0.15 | yes | 1.15 | 50 | 608 | 180 | comparative |
| 55 | Try11 | K | 934 | 2.9 | 521 | 26 | 2.88 | 27 | 0.15 | yes | 1.09 | 50 | 546 | 150 | comparative |

TABLE 5

| Test number | N* (mass %) | N** (mass %) | N amount at sheet-thickness center at position 5 mm away from sheared end face (mass %) | Fatigue strength σ w (Mpa) | d (mm) | Components status |
|---|---|---|---|---|---|---|
| 23 | 0.3732 | 0.1092 | 0.0043 | 509 | 0.209 | comparative |
| 24 | 0.7023 | 0.1023 | 0.0043 | 531 | 0.211 | invention |
| 25 | 0.7041 | 0.1010 | 0.0041 | 536 | 0.222 | invention |
| 26 | 0.7932 | 0.1033 | 0.0042 | 527 | 0.215 | invention |
| 27 | 0.9304 | 0.0923 | 0.0043 | 541 | 0.204 | invention |
| 28 | 1.3806 | 0.0432 | 0.0044 | 428 | 0.167 | comparative |
| 29 | 0.3353 | 0.0980 | 0.0042 | 481 | 0.209 | comparative |
| 30 | 0.3717 | 0.2173 | 0.0023 | 510 | 0.293 | comparative |
| 31 | 0.5321 | 0.2308 | 0.0022 | 534 | 0.301 | invention |
| 32 | 0.6452 | 0.2242 | 0.0025 | 531 | 0.288 | invention |
| 33 | 0.7427 | 0.2007 | 0.0020 | 546 | 0.269 | invention |
| 34 | 1.4689 | 0.0181 | 0.0022 | 431 | 0.125 | comparative |
| 35 | 0.3221 | 0.2433 | 0.0020 | 509 | 0.300 | comparative |
| 36 | 0.3521 | 0.0678 | 0.0029 | 476 | 0.201 | comparative |
| 37 | 0.7381 | 0.0668 | 0.0031 | 521 | 0.215 | invention |
| 38 | 0.8072 | 0.0653 | 0.0031 | 519 | 0.201 | invention |
| 39 | 0.9009 | 0.0622 | 0.0031 | 526 | 0.213 | invention |
| 40 | 1.3909 | 0.0450 | 0.0028 | 418 | 0.182 | comparative |
| 41 | 0.2753 | 0.0727 | 0.0033 | 463 | 0.216 | comparative |
| 42 | 0.3507 | 0.0203 | 0.0023 | 421 | 0.121 | comparative |
| 43 | 0.3265 | 0.0452 | 0.0033 | 463 | 0.163 | comparative |
| 44 | 0.7599 | 0.0524 | 0.0024 | 490 | 0.178 | comparative |
| 45 | 0.4881 | 0.1336 | 0.0045 | 536 | 0.232 | invention |
| 46 | 0.8060 | 0.1503 | 0.0022 | 542 | 0.248 | invention |

TABLE 5-continued

| Test number | N* (mass %) | N** (mass %) | N amount at sheet-thickness center at position 5 mm away from sheared end face (mass %) | Fatigue strength σ w (Mpa) | d (mm) | Components status |
|---|---|---|---|---|---|---|
| 47 | 0.9203 | 0.1817 | 0.0023 | 549 | 0.262 | invention |
| 48 | 0.9127 | 0.1946 | 0.0031 | 541 | 0.265 | invention |
| 49 | 0.3913 | 0.2250 | 0.0042 | 511 | 0.272 | comparative |
| 50 | 1.0232 | 0.0322 | 0.0030 | 438 | 0.111 | comparative |
| 51 | 0.8197 | 0.0730 | 0.0018 | 531 | 0.201 | invention |
| 52 | 0.4610 | 0.0678 | 0.0026 | 523 | 0.205 | invention |
| 53 | 0.3603 | 0.1418 | 0.0018 | 509 | 0.248 | comparative |
| 54 | 0.3512 | 0.0746 | 0.0028 | 488 | 0.201 | comparative |
| 55 | 0.3277 | 0.0708 | 0.0018 | 462 | 0.205 | comparative |

As a result of the fatigue test, only test numbers 24 to 27, 31 to 33, 37 to 39, 45 to 48, 51, and 52 that satisfied N* and N** exhibited fatigue strength equal to or higher than that of a carburized plate part. Note that test numbers 23, 30, and 36 exhibited an amount of plastic strain of less than 0.03%, and N* of less than 0.4000% in mass. On the other hand, test numbers 28, 34, and 40 that exhibited an amount of plastic strain exceeding 3.00% exhibited N* exceeding 1.2000% in mass without exception. Furthermore, even though the amount of plastic strain was equal to or greater than 0.03% and less than 3.00%, test numbers 29, 35, 41, 53, 54, and 55 that were subjected to coil recoiling after imparting strain exhibited N* of less than 0.7000% in mass. Test numbers 42 and 43 in which the ammonia gas ratio was 30% or less exhibited N* of less than 0.7% in mass and N** of less than 0.0600% in mass. Test number 49 in which the treatment temperature was less than 500° C. exhibited N* of less than 0.4% in mass, and test number 50 in which the treatment temperature was 620° C. or more exhibited N of less than 0.0600% in mass. In addition, test number 44 in which the treatment time was 50 minutes exhibited N of less than 0.0600% in mass. According to the above results, adequacy of the requirements of the present invention was verified.

Note that the present inventors experimentally recognized that it is difficult to bring N* and N** within the above-described ranges by the methods described in Patent Literatures 1 and 3.

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

The invention claimed is:

1. A nitrided plate part having a sheared end face, a sheet-thickness central portion in a portion at least 5 mm or more away from the sheared end face having a chemical composition consisting of, in mass %, C: equal to or greater than 0.025% and equal to or less than 0.113%, Si: 0.10% or less, Mn: equal to or greater than 0.71% and equal to or less than 1.49%, P: 0.020% or less, S: 0.0200% or less, Ti: equal to or greater than 0.020% and equal to or less than 0.091%, Cr: equal to or greater than 0.130% and equal to or less than 0.340%, Al: equal to or greater than 0.10% and equal to or less than 0.35%, N: equal to or greater than 0.0007% and equal to or less than 0.0300%, Nb: equal to or greater than 0% and equal to or less than 0.020%, Mo: equal to or greater than 0% and equal to or less than 0.140%, V: equal to or greater than 0% and equal to or less than 0.100%, B: equal to or greater than 0% and equal to or less than 0.0030%, Cu: equal to or greater than 0% and equal to or less than 0.13%, Ni: equal to or greater than 0% and less than 0.08%, W: equal to or greater than 0% and equal to or less than 0.07%, Co: equal to or greater than 0% and equal to or less than 0.07%, Ca: equal to or greater than 0% and less than 0.007%, Mg: equal to or greater than 0% and less than 0.005%, REM: equal to or greater than 0% and less than 0.005%, and the balance: Fe and impurities, wherein nitrogen average content n a range in which a distance from the sheared end face in a sheared end face normal direction is equal to or greater than 0.05 mm and equal to or less than 0.10 mm is equal to or greater than 0.4000% and equal to or less than 1.2000% in mass %, and minimum nitrogen content in a range in which the distance is equal to or greater than 0.015 mm and equal to or less than 0.200 mm is 0.0600% or more.

2. The nitrided plate part according to claim 1, wherein the nitrided plate part has a sheet thickness of equal to or greater than 1.0 mm and equal to or less than 8.0 mm.

3. The nitrided plate part according to claim 1, wherein the nitrided plate part has a sheet thickness of greater than 1.2 mm and equal to or less than 6.0 mm.

4. A method for producing a nitrided plate part, comprising:

obtaining a steel sheet by performing hot rolling at hot finish rolling exit-side temperature in a range of equal to or greater than 850° C. and less than 960° C. on a slab having a chemical composition consisting of, in mass %, C: equal to or greater than 0.025% and equal to or less than 0.113%, Si: 0.10% or less, Mn: equal to or greater than 0.71% and equal to or less than 1.49%, P: 0.020% or less, S: 0.0200% or less, Ti: equal to or greater than 0.020% and equal to or less than 0.091%, Cr: equal to or greater than 0.130% and equal to or less than 0.340%, Al: equal to or greater than 0.10% and equal to or less than 0.35%, N: equal to or greater than 0.0007% and equal to or less than 0.0100%, Nb: equal to or greater than 0% and equal to or less than 0.020%, Mo: equal to or greater than 0% and equal to or less than 0.140%, V: equal to or greater than 0% and equal to or less than 0.100%, B: equal to or greater than 0% and equal to or less than 0.0030%, Cu: equal to or greater than 0% and equal to or less than 0.13%, Ni: equal to or greater than 0% and less than 0.08%, W: equal to or greater than 0% and equal to or less than 0.07%, Co: equal to or greater than 0% and equal to or less than 0.07%, Ca: equal to or greater than 0% and less than 0.007%, Mg: equal to or greater than 0% and less than 0.005%, REM: equal to or greater than 0% and less than 0.005%, and the balance: Fe and impurities;

then starting cooling within three seconds from an end of hot finish rolling, and cooling the steel sheet to equal to or greater than 460° C. and equal to or less than 630° C. within 29 seconds from the end of hot finish rolling;

coiling the steel sheet into a steel sheet coil;

in regard to the steel sheet coil further subjected to pickling, uncoiling the steel sheet coil, and then applying bending/unbending in a range of equal to or greater than 0.03% and equal to or less than 3.00% in amount of plastic strain to the steel sheet;

performing shearing and press-forming to make the steel sheet into a plate part shape, without recoiling the steel sheet again; and nitriding the steel sheet by causing the steel sheet to stay in a closed furnace adjusted to a temperature of equal to or greater than 500° C. and less than 62.0° C. with an atmosphere in which a volume constituent ratio of ammonia gas is greater than 30?/t, for a time of 60 minutes or more.

* * * * *